US007084852B2

(12) United States Patent
Nishi et al.

(10) Patent No.: US 7,084,852 B2
(45) Date of Patent: Aug. 1, 2006

(54) LIQUID CRYSTAL PANEL DRIVING DEVICE

(75) Inventors: Kazuyoshi Nishi, Kyoto (JP); Yoshito Date, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 391 days.

(21) Appl. No.: 10/385,433

(22) Filed: Mar. 12, 2003

(65) Prior Publication Data

US 2003/0174119 A1 Sep. 18, 2003

(30) Foreign Application Priority Data

Mar. 13, 2002 (JP) ..... 2002-069005

(51) Int. Cl.
*G09G 3/36* (2006.01)

(52) U.S. Cl. ..... 345/98; 345/99; 345/92; 345/100; 345/95; 345/208

(58) Field of Classification Search ..... 345/87–103, 345/204–205, 208–210
See application file for complete search history.

(56) References Cited

U.S. PATENT DOCUMENTS

| | | | | |
|---|---|---|---|---|
| 5,093,655 | A * | 3/1992 | Tanioka et al. | 345/96 |
| 5,528,256 | A | 6/1996 | Erhart et al. | |
| 6,049,321 | A * | 4/2000 | Sasaki | 345/99 |
| 6,172,663 | B1 | 1/2001 | Okada et al. | |
| 6,229,530 | B1 | 5/2001 | Ushiki | |
| 6,271,816 | B1 | 8/2001 | Jeong et al. | |
| 6,304,241 | B1 * | 10/2001 | Udo et al. | 345/96 |
| 6,407,732 | B1 * | 6/2002 | Stiens et al. | 345/204 |
| 2001/0040589 | A1 | 11/2001 | Liang | |

FOREIGN PATENT DOCUMENTS

| | | | |
|---|---|---|---|
| EP | 0558059 | * | 9/1993 |
| EP | 0 755 044 | | 1/1997 |
| EP | 10-282524 | | 10/1998 |
| JP | 10-153761 | | 6/1998 |
| JP | 10-222130 | | 8/1998 |
| JP | P2000-221932 | A | 8/2000 |
| JP | 2001-515225 | A | 9/2001 |
| JP | 2002-62855 | A | 2/2002 |
| WO | WO 96/064621 | | 2/1996 |

* cited by examiner

*Primary Examiner*—Lun-Yi Lao
(74) *Attorney, Agent, or Firm*—McDermott Will & Emery LLP

(57) ABSTRACT

A switching-controlling section turns ON one of a transfer gate for high voltages or a transfer gate for low voltages and subsequently turns ON the other one of the transfer gates according to the outputs from the data latches only when the outputs from data latches are different from each other. Source lines are sequentially connected to a capacitor element for high voltages or a capacitor element for low voltages. For those source lines in which applied voltages change in a previous period and a subsequent period, an electric charge is stored and supplied effectively and power consumption is reduced, whereas for those source lines in which the applied voltages do not change, retained voltages do not vary so power is not consumed when subsequent voltages are applied. Power consumption in a liquid crystal panel driving device is reduced, and the time required for storing and supplying an electric charge is shortened. The circuit scale is also reduced.

3 Claims, 21 Drawing Sheets

FIG. 16

| | | period | voltage applied to source line | electric charge retained in source line (supplied electric charge) | | | | | | | | | | total supplied electric charge |
|---|---|---|---|---|---|---|---|---|---|---|---|---|---|---|
| pattern 1 | embodiment 4 | T1(line 1) | L L L L L | L L H L L | 0 | 0 | 0 | 0 | 0 | 0 | 0 | 6 | 0 | 0 | |
| | | T2 | | | 1 | 1 | 1 | 1 | 1 | 0 | 0 | 1 | 0 | 0 | |
| | | | | | | | | | | | | ↓ | | | |
| | | T3(line 2) | L L L L L | L L H L L | 0 | 0 | 0 | 0 | 0 | 0 | 0 | 6 | 0 | 0 | 5 |
| | | | | | | | | | | | | (5) | | | |
| | all lines short-circuited | T1(line 1) | L L L L L | L L H L L | 0 | 0 | 0 | 0 | 0 | 0 | 0 | 6 | 0 | 0 | |
| | | T2 | | | 0.6 | 0.6 | 0.6 | 0.6 | 0.6 | 0.6 | 0.6 | 0.6 | 0.6 | 0.6 | |
| | | | | | | | | | | | | ↓ | | | |
| | | T3(line 2) | L L L L L | L L H L L | 0 | 0 | 0 | 0 | 0 | 0 | 0 | 6 | 0 | 0 | 5.4 |
| | | | | | | | | | | | | (5.4) | | | |
| pattern 2 | 〃 | 〃 | L L L L L | L H H L L | 0 | 0 | 0 | 0 | 0 | 0 | 6 | 6 | 0 | 0 | |
| | | | | | 1.71 | 1.71 | 1.71 | 1.71 | 1.71 | 0 | 1.71 | 1.71 | 0 | 0 | |
| | | | | | | | | | | | ↓ | ↓ | | | |
| | | | L L L L L | L H H L L | 0 | 0 | 0 | 0 | 0 | 0 | 6 | 6 | 0 | 0 | 8.57 |
| | | | | | | | | | | | (4.29) | (4.29) | | | |
| | 〃 | 〃 | L L L L L | L H H L L | 0 | 0 | 0 | 0 | 0 | 0 | 6 | 6 | 0 | 0 | |
| | | | | | 1.2 | 1.2 | 1.2 | 1.2 | 1.2 | 1.2 | 1.2 | 1.2 | 1.2 | 1.2 | |
| | | | | | | | | | | | ↓ | ↓ | | | |
| | | | L L L L L | L H H L L | 0 | 0 | 0 | 0 | 0 | 0 | 6 | 6 | 0 | 0 | 9.6 |
| | | | | | | | | | | | (4.8) | (4.8) | | | |
| pattern 3 | 〃 | 〃 | L L L L L | L H H H L | 0 | 0 | 0 | 0 | 0 | 0 | 6 | 6 | 6 | 0 | |
| | | | | | 2.25 | 2.25 | 2.25 | 2.25 | 2.25 | 0 | 2.25 | 2.25 | 2.25 | 0 | |
| | | | | | | | | | | | ↓ | ↓ | ↓ | | |
| | | | L L L L L | L H H H L | 0 | 0 | 0 | 0 | 0 | 0 | 6 | 6 | 6 | 0 | 11.25 |
| | | | | | | | | | | | (3.75) | (3.75) | (3.75) | | |
| | 〃 | 〃 | L L L L L | L H H H L | 0 | 0 | 0 | 0 | 0 | 0 | 6 | 6 | 6 | 0 | |
| | | | | | 1.8 | 1.8 | 1.8 | 1.8 | 1.8 | 1.8 | 1.8 | 1.8 | 1.8 | 1.8 | |
| | | | | | | | | | | | ↓ | ↓ | ↓ | | |
| | | | L L L L L | L H H H L | 0 | 0 | 0 | 0 | 0 | 0 | 6 | 6 | 6 | 0 | 12.6 |
| | | | | | | | | | | | (4.2) | (4.2) | (4.2) | | |
| pattern 4 | 〃 | 〃 | L L L L L | L H H H H | 0 | 0 | 0 | 0 | 0 | 0 | 6 | 6 | 6 | 6 | |
| | | | | | 2.67 | 2.67 | 2.67 | 2.67 | 2.67 | 0 | 2.67 | 2.67 | 2.67 | 2.67 | |
| | | | | | | | | | | | ↓ | ↓ | ↓ | ↓ | |
| | | | L L L L L | L H H H H | 0 | 0 | 0 | 0 | 0 | 0 | 6 | 6 | 6 | 6 | 13.33 |
| | | | | | | | | | | | (3.33) | (3.33) | (3.33) | (3.33) | |
| | 〃 | 〃 | L L L L L | L H H H H | 0 | 0 | 0 | 0 | 0 | 0 | 6 | 6 | 6 | 6 | |
| | | | | | 2.4 | 2.4 | 2.4 | 2.4 | 2.4 | 2.4 | 2.4 | 2.4 | 2.4 | 2.4 | |
| | | | | | | | | | | | ↓ | ↓ | ↓ | ↓ | |
| | | | L L L L L | L H H H H | 0 | 0 | 0 | 0 | 0 | 0 | 6 | 6 | 6 | 6 | 14.4 |
| | | | | | | | | | | | (3.6) | (3.6) | (3.6) | (3.6) | |
| pattern 5 | 〃 | 〃 | L L H H L | L H H H H | 0 | 0 | 6 | 6 | 0 | 0 | 6 | 6 | 6 | 6 | |
| | | | | | 3.43 | 3.43 | 4 | 4 | 3.43 | 4 | 3.43 | 3.43 | 3.43 | 3.43 | |
| | | | | | | | ↓ | ↓ | | | ↓ | ↓ | ↓ | ↓ | |
| | | | L L H H L | L H H H H | 0 | 0 | 6 | 6 | 0 | 0 | 6 | 6 | 6 | 6 | 14.29 |
| | | | | | | | (2) | (2) | | | (2.57) | (2.57) | (2.57) | (2.57) | |
| | 〃 | 〃 | L L H H L | L H H H H | 0 | 0 | 6 | 6 | 0 | 0 | 6 | 6 | 6 | 6 | |
| | | | | | 3.6 | 3.6 | 3.6 | 3.6 | 3.6 | 3.6 | 3.6 | 3.6 | 3.6 | 3.6 | |
| | | | | | | | ↓ | ↓ | | | ↓ | ↓ | ↓ | ↓ | |
| | | | L L H H L | L H H H H | 0 | 0 | 6 | 6 | 0 | 0 | 6 | 6 | 6 | 6 | 14.4 |
| | | | | | | | (2.4) | (2.4) | | | (2.4) | (2.4) | (2.4) | (2.4) | |

LIQUID CRYSTAL PANEL DRIVING DEVICE

BACKGROUND OF THE INVENTION

The present invention relates to technologies pertaining to liquid crystal panel driving devices used for driving liquid crystal display devices that employ a so-called active matrix liquid crystal panel in which an electric charge is stored in between an opposing electrode and pixel electrodes by applying voltages corresponding to image data to the pixel electrodes through source lines and pixel switches.

An active matrix type liquid crystal display device has, as shown in FIG. 21, for example, a liquid crystal panel 907, a gate driver 908, and a source driver 909. The liquid crystal panel 907 comprises a liquid crystal layer 901, pixel electrodes 902, opposing electrodes 903, pixel switches 904 comprising TFTs (Thin Film Transistors), gate lines 905, and source lines 906.

The gate driver 908 sequentially applies drive pulses to the gate lines 905. The source driver 909 applies voltages corresponding to image data for the respective pixels to the source lines 906. Specifically, the source lines 906 receives the voltages that successively change corresponding to image data for the pixels corresponding to the gate lines 905 to which the sequential drive pulses are input, and the voltages are retained in between the pixel electrodes 902 and the opposing electrodes 903 (in a liquid crystal capacitance), so that images are displayed.

In such liquid crystal display devices as described above, power is consumed mainly because of the electric current flow that charges and discharges the liquid crystal capacitance and the parasitic capacitance in the source lines 906 at the time when the applied voltages to the source lines 906 change. Especially when a line inversion drive, in which the polarities are reversed in every other set of pixels corresponding to the gate lines 905 adjacent to each other, is carried out to prevent picture quality degradation, the charge-discharge current that flows each time of the polarity reversal is large, and therefore, power consumption tends to be large even when the difference in display contrast among pixels is small.

Reducing the power consumption as described above is an important issue for, for example, devices that need to be driven by batteries for long hours, as exemplified by portable terminal devices such as mobile telephones, which have rapidly become widespread. In view of this, various technologies have been proposed to reduce the power consumption as described above.

For example, Japanese Unexamined Patent Publication No. 2000-221932 discloses the technology as follows; before the source driver newly applies voltages to source lines, all the source lines are temporality connected to each other to average the potentials of the source lines, and thus the current flow is reduced at the time when the source driver applies voltages corresponding to image data.

Also, Published Japanese Translation of PCT publication No. 9-504389 discloses a technology in which, before the source driver newly applies voltages to source lines, a capacitor is connected to the source lines so that an electric charge is stored into the capacitor or the stored charge is discharged therefrom, in order to average the potentials of the source lines.

Japanese Unexamined Patent Publication No. 10-222130 discloses the following technique. Using a capacitor for positive polarity and a capacitor for negative polarity, for example, before applying a negative voltage after a positive voltage has been applied, the capacitor for positive polarity is first connected to the source line to store a positive electric charge in the capacitor and to reduce the potential of the source line, and next, the capacitor for negative polarity in which a negative electric charge is stored is connected to the source line to further reduce the potential of the source line. This technique is intended to reduce the current flow at the time of the subsequent negative voltage application.

These conventional liquid crystal panel driving devices, however, have a problem in that none of them can reduce the power consumption significantly. Specifically, when all the source lines are connected to each other uniformly or capacitors are connected thereto, every source line is made to have an average potential, For this reason, when a voltage is applied at a similar magnitude to that applied previously, it is necessary to supply an electric charge to raise or reduce the potentials of the source lines once again. This causes an unnecessary electric charge shift, which correspondingly increases power consumption. Moreover, when capacitors are connected twice each time a voltage corresponding to image data is applied to the source lines, as described in Japanese Unexamined Patent Publication No. 10-222130, the time required for the sequence becomes long. This may cause a problem in that it is difficult to display images at an appropriate scanning frequency.

SUMMARY OF THE INVENTION

In view of the foregoing and other problems, it is an object of the present invention to achieve a significant reduction in power consumption in a simple manner. It is another object of the invention to shorten the time required for storing or supplying the electric charge as well as to reduce the circuit scale.

This and other objects are accomplished in accordance with a first aspect of the present invention by providing a liquid crystal panel driving device for a liquid crystal display device comprising source lines, pixel switches, pixel electrodes connected to the source lines through the pixel switches, and an opposing electrode opposed to the pixel electrodes, the liquid crystal panel driving device alternately applying to the pixel electrodes through the source lines high voltages and low voltages that are respectively higher and lower than a predetermined voltage, both of the voltages corresponding to image data for pixels, the liquid crystal panel driving device comprising: a charge-storing means for storing an electric charge; a charge-storing means-connecting means for connecting and disconnecting the source lines and the storing means; an opposing electrode-connecting means for connecting and disconnecting the source lines and the opposing electrode; and a controlling means for controlling the charge-storing means-connecting means and the opposing electrode-connecting means such that, after applying one of the high voltage and the low voltage to a set of the pixel electrodes but before applying the other one of the voltages to a subsequent set of the pixel electrodes, the source lines are connected to the electric charge-storing means and subsequently the source lines are connected to the opposing electrode.

In this configuration, the source lines are connected to the charge-storing means and thereafter to the opposing electrode, and the potential of each source line becomes approximately an intermediate potential between a high voltage and a low voltage. Therefore, it is possible to reduce the electric charge that is to be supplied when a high voltage or a low voltage is applied next, in comparison to the case where it is applied as the each of the source lines is at the original potential. Therefore, power consumption can be easily reduced.

The present invention provides, in a second aspect thereof, a liquid crystal panel driving device according to the first aspect, wherein the charge-storing means comprises a first charge-storing means and a second charge-storing means; the charge-storing means-connecting means comprises a first charge-storing means connecting-means for connecting and disconnecting the first charge-storing means, and a second charge-storing means-connecting means for connecting and disconnecting the second electric charge-storing means; and the charge-storing means-connecting means further comprises a mutually-connecting means for mutually connecting and disconnecting the first charge-storing means and the second charge-storing means; and the controlling means controls the first charge-storing means-connecting means, the second charge-storing means-connecting means, and the mutually-connecting means such that, after applying the high voltages to a previous set of the pixel electrodes but before applying the low voltages to a subsequent set of the pixel electrodes, the source lines are connected to the first electric charge-storing means at first timing and thereafter the source lines are connected to the opposing electrode at second timing, and after applying the low voltages to the subsequent set of the pixel electrodes but before applying the high voltages to a further subsequent set of the pixel electrodes, the source lines are connected to the second electric charge-storing means at third timing and thereafter the source lines are connected to the opposing electrode at fourth timing, and the first electric charge-storing means and the second electric charge-storing means are mutually connected at fifth timing that is later than the first timing or the third timing.

In this configuration, the source lines are connected to the first or the second charge-storing means so that the electric charge is stored therein or supplied therefrom at the first and the third timing, and the source lines are connected to the opposing electrode at the second and the fourth timing. As a result, the voltages of the source lines are brought closer to the voltages to be applied next. Therefore, the current flow at the time of the subsequent voltage application can be reduced, and thus power consumption can be reduced. In addition, the first and the second charge-storing means are mutually connected at the fifth timing, and consequently, the voltages of these charge-storing means results in the voltage of the opposing electrode on average. Therefore, the storing and supplying of electric charge as described above can be carried out efficiently.

The present invention provides, in a third aspect thereof, a liquid crystal panel driving device according to the first aspect, wherein the charge-storing means comprises a first charge-storing means and a second charge-storing means; the charge-storing means-connecting means comprises a first charge-storing means-connecting means for connecting and disconnecting the first charge-storing means and a second charge-storing means-connecting means for connecting and disconnecting the second charge-storing means; and the controlling means controls the first charge-storing means-connecting means and the second charge-storing means-connecting means such that, after applying one of the high voltages and the low voltages to a previous set of the pixel electrodes but before applying the other one of the voltages to a next set of the pixel electrodes, the source lines are connected at first timing to one of the first charge-storing means and the second charge-storing means corresponding to the applied voltages, thereafter the source lines are connected to the opposing electrode at second timing, and the source lines are connected to the other one of the first charge-storing means and the second charge-storing means at third timing that is later than the second timing.

In this configuration, the source lines are connected to one of the first or the second charge-storing means at the first timing, and an electric charge is stored therein or supplied therefrom. Thereafter, the source lines are connected to the opposing electrode at the second timing and further thereafter connected to the other one of the first and the second charge-storing means at the third timing. As a result, the voltages of the source lines are brought even closer to the voltages to be applied next. Therefore, the current flow at the time of the subsequent voltage application can be further decreased, and power consumption can be reduced.

The present invention provides, in a fourth aspect thereof, a liquid crystal panel driving device for a liquid crystal display device comprising source lines, pixel switches, pixel electrodes connected to the source lines through the pixel switches, and an opposing electrode opposed to the pixel electrodes, the liquid crystal panel driving device alternately applying to the pixel electrodes through the source lines high voltages and low voltages that are respectively higher and lower than a predetermined voltage, both of the voltages corresponding to image data for pixels, the liquid crystal panel driving device comprising: a charge-storing means for storing an electric charge; a charge-storing means-connecting means for selectively connecting and disconnecting the source lines to one of terminals of the charge-storing means or the other one of the terminals thereof; and a controlling means for controlling the charge-storing means-connecting means such that, after applying one of the high voltages and the low voltages to the pixel electrodes but before applying the other one of the voltages to the pixel electrodes, the source lines are connected to one of the terminals of the charge-storing means at first timing, and thereafter, the source lines are connected to the other one of the terminals of the charge-storing means at second timing.

With this configuration, one charge-storing means can serve both as the charge-storing means for high voltages and the charge-storing means for low voltages. Therefore, power consumption can be reduced, and the circuit scale can also be reduced.

The present invention provides, in a fifth aspect thereof, a liquid crystal panel driving device according to the fourth aspect further comprises an opposing electrode-connecting means for connecting and disconnecting the source lines and the opposing electrode; and wherein the controlling means controlling the opposing electrode-connecting means such that the source lines are connected to the opposing electrode at third timing that is between the first timing and the second timing.

With this configuration, the circuit scale can be reduced. In addition, as explained regarding the liquid crystal panel driving device according to the second aspect, the voltages of the source line are further brought close to the voltages to be applied next; as a consequence, the current flow at the time of the subsequent voltage application can be decreased, and power consumption can thus be reduced.

The present invention provides, in a sixth aspect thereof, a liquid crystal panel driving device for a liquid crystal display device comprising source lines, pixel switches, pixel electrodes connected to the source lines through the pixel switches, and an opposing electrode opposed to the pixel electrodes, the liquid crystal panel driving device applying to the pixel electrodes voltages corresponding to image data for pixels through the source lines, the liquid crystal panel driving device comprising: a charge-utilizing means for utilizing an electric charge of the source lines; a charge-utilizing means-connecting means for connecting and disconnecting the source lines and the charge-utilizing means; and a controlling means for controlling the charge-utilizing means-connecting means based on at least one of the first voltage and the second voltage after applying a first voltage to a previous set of the pixel electrodes but before applying a second voltage to a subsequent set of the pixel electrodes.

In this configuration, an electric charge is utilized according to the voltages actually applied to the source lines. Therefore, the current flow at the time of the subsequent voltage application can be decreased, and power consumption can be reduced.

The present invention provides, in a seventh aspect thereof, a liquid crystal panel driving device according to the sixth aspect, in which the charge-utilizing means comprises a plurality of charge-storing means for storing an electric charge; and the controlling means controls the charge-utilizing means-connecting means such that, after applying a first voltage to a previous set of the pixel electrodes but before applying a second voltage to a subsequent set of the pixel electrodes, the source lines are connected at first timing to one of the plurality of charge-storing means selected according to the first voltage, and thereafter the source lines are connected at second timing to another one the plurality of charge-storing means selected according to the second voltage.

In this configuration, the source lines are connected to one of the charge charge-storing means selected according to the first or the second voltage. Therefore, an unnecessary shift of electric charge between the source lines can be reduced, and efficiency in utilizing the electric charge can be improved further.

The present invention provides, in an eighth aspect thereof, a liquid crystal panel driving device according to the seventh aspect, in which the image data are multi-level image data; the plurality of charge-storing means are provided so as to correspond to voltage groups, respectively, each of the voltage groups including voltages that are applied to the pixel electrodes corresponding to the multi-level image data and are grouped together into at least one kind of voltage; and the controlling means controls the charge-utilizing means-connecting means such that the source lines are connected at the first timing to the charge-storing means that corresponds to the voltage group that includes the first voltage, and the source lines are connected at the second timing to the charge-storing means that corresponds to the voltage group that includes the second voltage.

With this configuration, in cases where multi-level images are to be displayed, an unnecessary shift of electric charge can be reduced and efficiency in utilizing the electric charge can be improved further.

The present invention provides, in a ninth aspect thereof, a liquid crystal panel driving device according to the seventh aspect, in which the image data are binary level image data; the plurality of charge-storing means comprises a charge-storing means for high voltages and a charge-storing means for low voltages that correspond to voltages applied to the pixel electrodes corresponding to the binary level image data; the controlling means controls the charge-utilizing means-connecting means such that the source lines are connected at the first timing to the charge-storing means for high voltages or the charge-storing means for low voltages corresponding to the first voltage, and the source lines are connected at the second timing to the charge-storing means for high voltages or the charge-storing means for low voltages corresponding to the second voltage.

With this configuration, in cases where binary level images are to be displayed as well, an unnecessary shift of electric charge can be reduced and efficiency in utilizing the electric charge can be further improved in a similar manner.

The present invention provides, in a tenth aspect thereof, a liquid crystal panel driving device according to the seventh aspect, in which the controlling means controls whether or not the source lines are connected to one of the charge storing means at the first timing and the second timing according to the first voltage and the second voltage.

The present invention provides, in an eleventh aspect thereof, a liquid crystal panel driving device according to the tenth aspect, in which the controlling means controls the charge-utilizing means-connecting means such that the source lines are connected to one of the charge storing means at the first timing and the second timing when the voltage difference between the first voltage and the second voltage is equal to or greater than a predetermined difference.

With these configurations, an unnecessary shift of electric charge is prevented when the change in the voltages applied to the source lines is small. Therefore, the efficiency in utilizing the electric charge can be improved further.

The present invention provides, in a twelfth aspect thereof, a liquid crystal panel driving device according to the sixth aspect, in which the charge-utilizing means comprises a first source line-connecting line and a second source line-connecting line, each connecting the source lines one another; the charge-utilizing means-connecting means comprises; a first connecting line-connecting means for selectively connecting and disconnecting the source lines and the first source line-connecting line; and a second connecting line-connecting means for selectively connecting and disconnecting the source lines and the second source line-connecting line; and the controlling means controls the first connecting line-connecting means and the second connecting line-connecting means such that, after applying a first voltage to a previous set of the pixel electrodes but before applying a second voltage to a subsequent set of the pixel electrodes, among the source lines grouped into at least a first group and a second group, the source lines of the first group are connected to the first source line-connecting line when the first voltage is higher than a predetermined voltage but are connected to the second source line-connecting line when the first voltage is lower than the predetermined voltage, and the source lines of the second group are connected to the first source line-connecting line when the first voltage is lower than the predetermined voltage but are connected to the second source line-connecting line when the first voltage is higher than the predetermined voltage.

In this configuration, each group of the source lines is connected in the above-described manner according to the voltages applied thereto. As a result, the voltages of the source lines can be brought closer to the voltages to be applied next so that the current flow at the time of the subsequent voltage application can be decreased and power consumption can be reduced, in cases of, for example, displays in which the pixels in adjacent display lines show a strong correlation of the display patterns, such as the displays in computer screens or the like that extensively use window displays and line/border displays. Moreover, the circuit scale can be significantly reduced since the use of charge-storing means is unnecessary.

The present invention provides, in a thirteenth aspect thereof, a liquid crystal panel driving device according to the twelfth aspect, in which the controlling means controls whether or not the source lines are connected to the first source line-connecting line or the second source line-connecting line according to the first voltage and the second voltage.

The present invention provides, in a fourteenth aspect thereof, a liquid crystal panel driving device according to the thirteenth aspect, in which the controlling means controls the charge-utilizing means-connecting means such that the source lines are connected to the first source line-connecting line or the second source line-connecting line when the voltage difference between the first voltage and the second voltage is equal to or greater than a predetermined difference.

With these configurations, an unnecessary shift of electric charge is prevented when the change in the voltages applied to the source lines is small. Therefore, the efficiency in utilizing the electric charge can be improved further.

The present invention provides, in a fifteenth aspect thereof, a liquid crystal panel driving device according to the sixth aspect, in which the charge-utilizing means comprises a source line-connecting line that connects the source lines one another; and the controlling means controls the charge-utilizing means-connecting means such that after applying a first voltage to a previous set of the pixel electrodes but before applying a second voltage to a subsequent set of the pixel electrodes, the source lines are connected to the source line-connecting line according to the first voltage and the second voltage.

The present invention provides, in a sixteenth aspect thereof, a liquid crystal panel driving device according to the fifteenth aspect, in which the controlling means controls the charge-utilizing means-connecting means such that the source lines are connected to the source line-connecting line when the voltage difference between the first voltage and the second voltage is equal to or greater than a predetermined difference.

With this configuration as well, an unnecessary shift of electric charge is prevented when the change in the voltages applied to the source lines is small. Therefore, the efficiency in utilizing the electric charge can be improved further. Moreover, the circuit scale can be significantly reduced since the use of charge-storing means is unnecessary.

BRIEF DESCRIPTION OF THE DRAWINGS

FIG. 16 illustrates a specific example of an operation of the liquid crystal display device;

DETAILED DESCRIPTION OF THE INVENTION

Hereinafter, preferred embodiments of the present invention are described with reference to the drawings.

Embodiment 1

Figure 1:
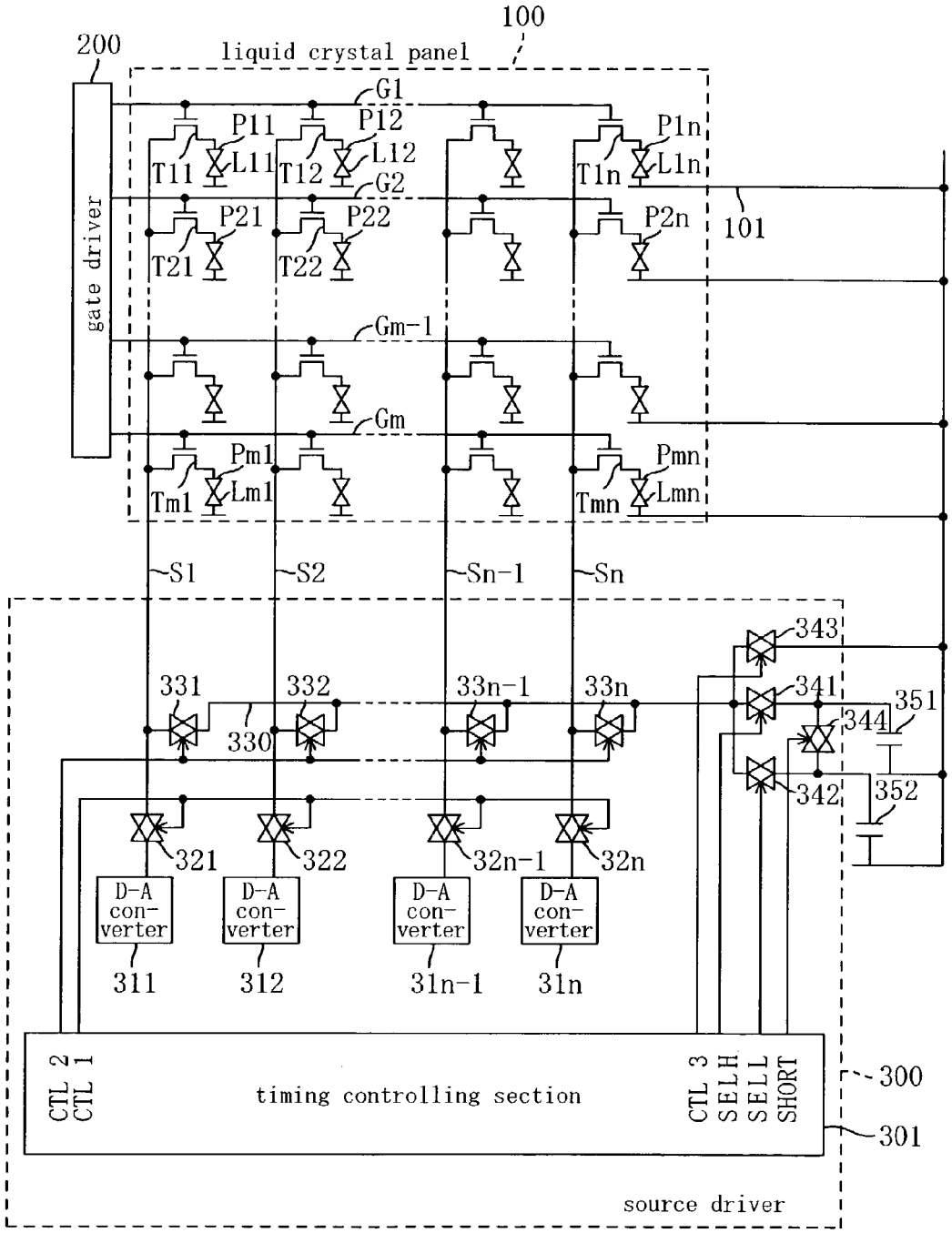
FIG. 1 is a circuit diagram showing a liquid crystal display device according to Embodiment 1.

FIG. 1 is a circuit diagram schematically showing the configuration of a primary portion of a liquid crystal display device that comprises a line inversion drive-type source driver (liquid crystal panel driving device) 300 according to Embodiment 1 of the present invention, a gate driver 200, and a liquid crystal panel 100. The line inversion drive is such that the polarity of the voltage applied to a pixel electrode is reversed at every horizontal scanning period with respect to the polarity of a later-described opposing electrode in order to prevent degradation in the quality of images displayed on the liquid crystal panel 100. Generally, the line inversion drive is achieved by either of the following methods. In one method, while the potential of the opposing electrode is being maintained at a constant potential, a voltage having a higher or lower potential than the constant potential is applied to a pixel electrode. In the other method, the potential of the opposing electrode is changed to reverse its relationship with the voltages applied to the pixel electrodes. For the sake of simplicity in illustration, only the examples employing the former method are discussed herein.

As shown in FIG. 1, the liquid crystal panel 100 comprises:

a liquid crystal layer L11–Lmn;

pixel electrodes P11–Pmn;

an opposing electrode 101;

pixel switches T11–Tmn composed of, for example, TFTs (Thin Film Transistors);

gate lines G1–Gm; and source line S1–Sn, such that it displays images by retaining image signal voltages corresponding to image data in between the pixel electrodes P11–Pmn and the opposing electrode 101, in other words, in a liquid crystal capacitance.

The gate driver 200 applies drive pulses to gate lines G1–Gm successively to turn ON the pixel switches T11–Tmn that are respectively connected to the gate lines G1–Gm so that the voltages of the source lines S1–Sn are applied to the pixel electrodes P11–Pmn.

The source driver 300 applies image signal voltages for respective pixels to the source lines S1–Sn. More specifically, the source driver 300 is provided with D-A converters 311–31*n* for converting digital image data into analog voltage signals, and the D-A converters 311–31*n* are connected to the source lines S1–Sn through DAC-connecting transfer gates 321–32*n*, respectively.

The source lines S1–Sn are connected to one another through transfer gates 331–33*n* for a connecting line and through a source line-connecting line 330, and the source line-connecting line 330 is connected to one end of a positive polarity capacitor element 351, or one end of a negative polarity capacitor element 352, or the opposing electrode 101, through a transfer gate 341 for the positive polarity capacitor element, or a transfer gate 342 for the negative polarity capacitor element, or a transfer gate 343 for the opposing electrode, respectively. The capacitor elements 351 and 352 store and supply a negative or positive electric charge for parasitic capacitors or the like in the source lines S1–Sn. The capacitor elements 351 and 352 are connected to each other at one end thereof through a transfer gate 344 for short-circuiting. The other ends of the capacitor elements 351 and 352 may be, though not necessarily, connected to the opposing electrode 101, for example.

The above-mentioned transfer gates 321 and so forth are controlled by control signals CTL1, CTL2, CTL3, SELH, SELL, and SHORT, which are output from a timing controlling section 301.

In the liquid crystal display device thus configured, image signal voltages corresponding to image data are retained (written) in between the pixel electrodes P11–Pmn and the opposing electrode 101 by the operation according to changes in the control signals shown in FIG. 2, which will be described below.

Period T1

This is a period in which any one of the gate lines G1–Gm, for example, a gate line G1, becomes an H level and the pixel electrodes P11–P1*n* that are in the first line on the screen are written. First, in this period, before the gate line G1 becomes an H level, the control signal CTL1 becomes an H level, turning ON the DAC-connecting transfer gates 321–32*n*, and the image signal voltages having positive polarity with respect to, for example, the opposing electrode 101 are output from the D-A converter 311–31*n* and applied to the source lines S1–Sn. At that time, when an H-level drive pulse is output from the gate driver 200 to the gate line G1, as described above, the pixel switches T11–T1*n* connected to the gate line G1 are turned ON, and the image signal voltages output from the D-A converters 311–31*n* are applied to the pixel electrodes P11–P1*n*. The image signal voltages are then retained in the liquid crystal capacitance between the pixel electrodes P11–P1*n* and the opposing electrode 101. These voltages are also retained in the parasitic capacitance in the source lines S1–Sn.

Period T2

Next, CTL1 becomes an L level, and the DAC-connecting transfer gates 321–32*n* are turned OFF. Meanwhile, CTL2 and SELH become an H level, and the transfer gates 331–33*n* for a connecting line and the transfer gate 341 for the positive polarity capacitor element are turned ON. Accordingly, the source lines S1–Sn are disconnected from the D-A converters 311–31*n* but are connected the positive polarity capacitor element 351. At that time, the positive electric charge retained in the parasitic capacitance of the source lines S1–Sn is shifted to the positive polarity capacitor element 351, and the potentials of the source lines S1–Sn are reduced.

Period T3

SELH becomes an L level, and the transfer gate 341 for the positive polarity capacitor element is turned OFF. Meanwhile CTL3 becomes an H level, and the transfer gate 343 for the opposing electrode is turned ON. Accordingly, the source lines S1–Sn are disconnected from the positive polarity capacitor element 351 but are connected to the opposing electrode 101. At that time, the potentials of the source lines S1–Sn further decrease, resulting in the same potential as that of the opposing electrode 101.

Period T4

In this period, voltages with negative polarity are written into the pixel electrodes P21-P2*n* that are on the second line on the screen in a similar manner to that discussed in the above-described period T1. Specifically, CTL1 becomes an H level, turning ON the DAC-connecting transfer gates 321–32*n*, and the image signal voltages with negative polarity that are output from the D-A converters 311–31*n* are applied to the source lines S1–Sn. Then, a drive pulse is output from the gate driver 200 to the gate line G2 that is the next one of the gate line G1 to which a drive pulse is applied in the above-described period T1, and image signal voltages with negative polarity that are output from the D-A converters 311–31*n* are applied and retained into the corresponding pixel electrodes P21–P2*n*. Here, the voltages of the source lines S1–Sn have been brought to the same level as the voltage of the opposing electrode 101 before the image signal voltages are applied, as described above, and therefore, power consumption is reduced in comparison with the case where the image signal voltages with negative polarity are applied while the image signal voltages with positive polarity are kept retained.

Period T5

This period is similar to the above-described period T2. SELL, instead of SELH, becomes an H level, turning ON the transfer gate 342 for the negative polarity capacitor element, and the source lines S1–Sn are disconnected from the D-A converters 311–31*n* but are connected to the negative polarity capacitor element 352. At that time, the negative electric charge retained in the parasitic capacitance in the source lines S1–Sn is shifted to the negative polarity capacitor element 352, and the potentials of the source lines S1–Sns are increased.

Period T6

When SELL becomes an L level and CTL3 becomes an H level, the transfer gate 342 for the negative polarity capacitor element is turned OFF and the transfer gate 343 for the opposing electrode is turned ON. Accordingly, the source lines S1–Sn are connected to the opposing electrode 101, and the potentials of the source lines S1–Sn are further increased, resulting in the same potential level as that of the opposing electrode 101.

Period T7 Onward

Thereafter, the same operations as in the above-described periods T1 through T6 are repeated, and thereby, the image signal voltages that are output from the D-A converters 311–31*n* are sequentially applied to the pixel electrodes P11–Pmn corresponding to the gate lines G1–Gm; consequently, an image for one screen frame is displayed.

Also, during the above-described period T7, for example, when SHORT becomes an H level and the transfer gate 344 for short-circuiting is turned ON so that the capacitor elements 351 and 352 are short-circuited, the voltage between the terminals of the capacitor elements 351 and 352 becomes the averaged voltage that is obtained before the short-circuiting. This averaged voltage results in approximately the same voltage as that of the opposing electrode 101 in terms of probability.

Therefore, as described above, by connecting the capacitor elements 351 and 352 to the source lines S1–Sn and subsequently connecting the opposing electrode 101 to the source lines S1–Sn in the period T2 or the period T5, the voltages of the source lines S1–Sn can be reduced or raised. Consequently, it is possible to reduce the power consumption that is consumed when the subsequent image signal voltages corresponding to image data are applied.

In the foregoing example, it has been explained, for convenience in description, as if the voltages of the source lines S1–Sn have either positive polarity or negative polarity, but it should be understood that the polarities here are relative to the potential of the opposing electrode 101. Therefore, even if the voltages of the source lines S1–Sn have positive polarity or negative polarity, for example, with respect to a ground potential or a predetermined reference potential of a power supply, power consumption can be reduced according to the same mechanism.

In addition, it has been explained as if the potential of the opposing electrode 101 is constant, but the potential thereof may be varied to make the voltages of the source lines S1–Sn have negative polarity. In this case as well, the essential operation such as the shift of electric charge remains the same.

Further, the foregoing example illustrates that the other ends of the capacitor elements 351 and 352 are connected to the opposing electrode 101, but this is not meant to limit the embodiment. That is, even if the capacitor elements 351 and 352 are connected to a potential that is other than that of the opposing electrode 101, the operation is the same as described above although the electric charge stored in the capacitor elements 351 and 352 increases or decreases according to the potential difference between the other potential and the potential of the opposing electrode 101. Here, It should be noted that in the case where the capacitor elements 351 and 352 are connected to the opposing electrode 101 as described above, the potential of the one ends becomes the same potential as that of the opposing electrode 101, that is, the same level as the potential of the other ends when the one ends of the capacitor elements 351 and 352 are short circuited with each other. For this reason, in the case where the other ends of the capacitor elements 351 and 352 are connected to the opposing electrode 101, both ends of the capacitor elements 351 and 352 may be short-circuited individually to discharge the electric charge stored in the capacitor elements 351 and 352 in place of the short-circuiting in the above-described manner.

Further, in order to short-circuit the capacitor elements 351 and 352 with each other, it is possible to turn ON the transfer gate 341 for the positive polarity capacitor element and the transfer gate 342 for the negative polarity capacitor element at the same time, in place of using the transfer gate 344 for short-circuiting.

The period in which the capacitor elements 351 and 352 are short-circuited is not limited to the period T7, but may also be any of the period T3, T4, or T6. In other words, it is sufficient as long as both the capacitor elements 351 and 352 are disconnected from the source lines S1–Sn in the period.

Figure 3:
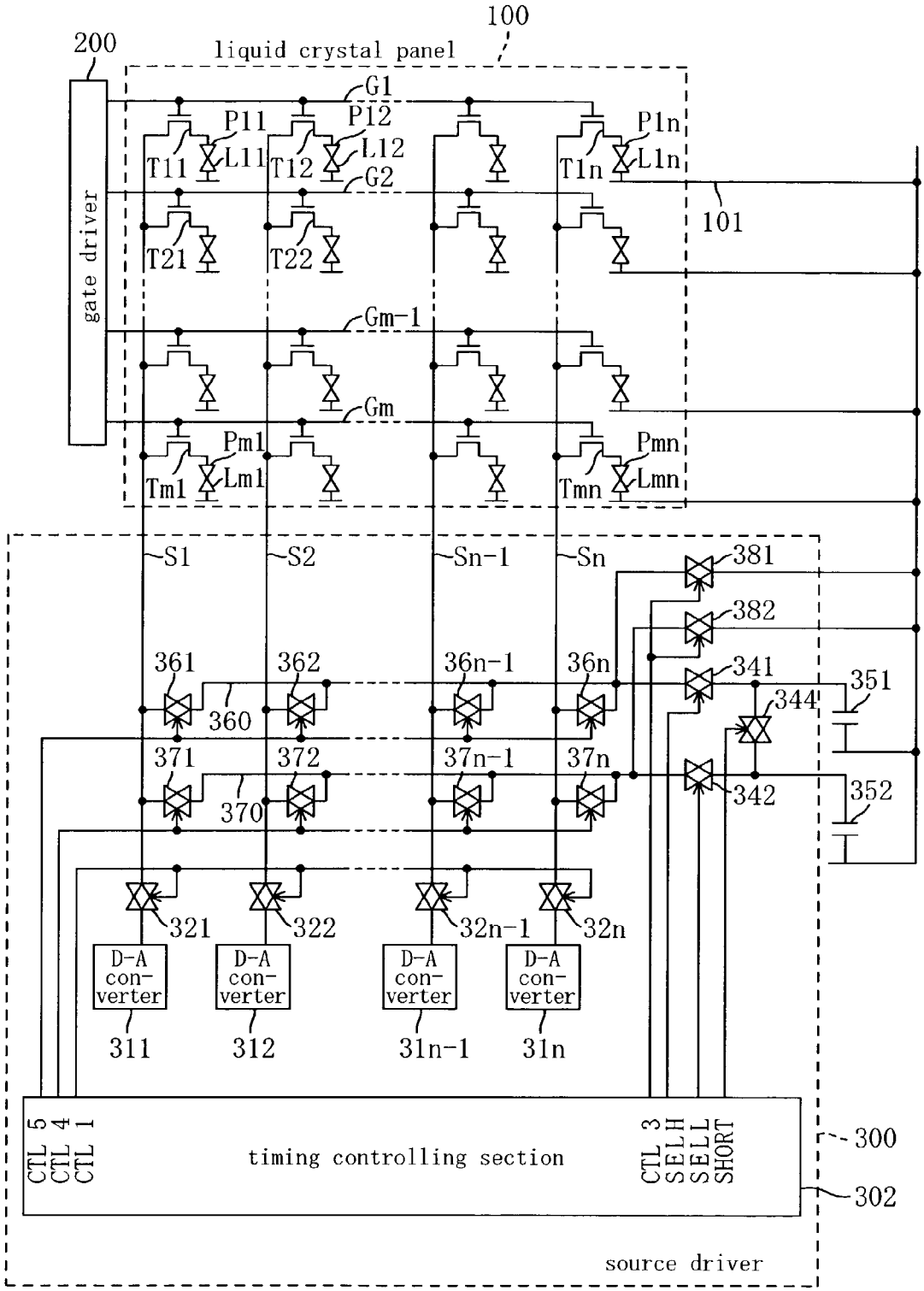
FIG. 3 is a circuit diagram showing a variation of the liquid crystal display device according to Embodiment 1.
Figure 4:
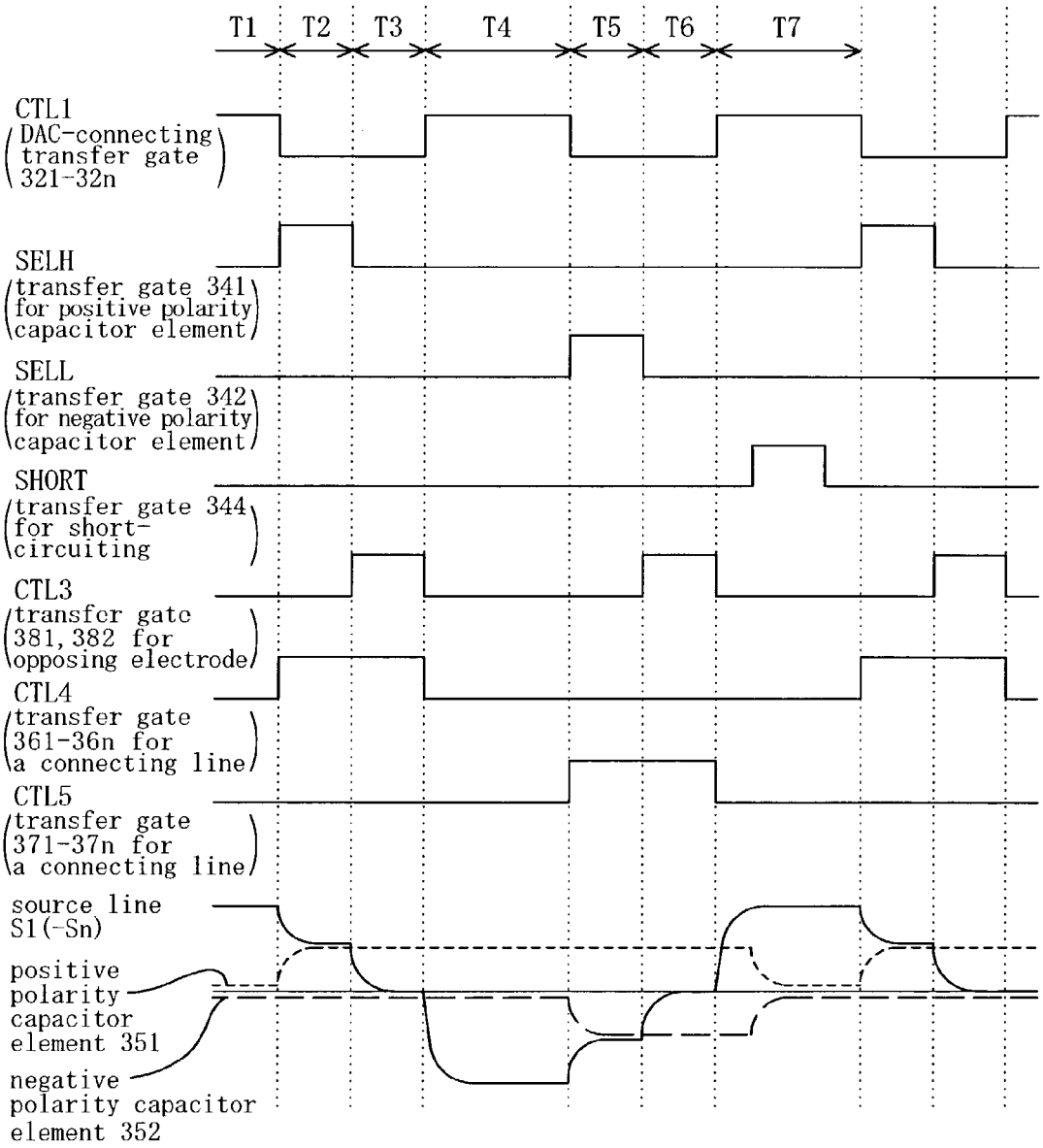
FIG. 4 is a timing chart showing the operation of the liquid crystal display device.

The relationship of connection with the transfer gates 321 and so forth is not limited to that described in the foregoing example, but may be configured as shown in FIG. 3. In the example shown in the figure, the source lines S1–Sn can be connected to the positive polarity capacitor element 351 through transfer gates 361–36*n* for a connecting line, a source line-connecting line 360, and a transfer gate 341 for the positive polarity capacitor element. Meanwhile, the source lines S1–Sn can be connected to the negative polarity capacitor element 352 through transfer gates 371–37*n* for a connecting line, a source line-connecting line 370, and a transfer gate 342 for the negative polarity capacitor element. The source line-connecting lines 360 and 370 are respectively connected to the opposing electrode 101 through transfer gates 381 and 382 for the opposing electrode. Even when this configuration is employed, substantially the same operation can be performed by controlling the transfer gates 361 and so forth using the control signals CTL1, CTL3 to CTL5, SELH, SELL, and SHORT as shown in FIG. 4, and as a result, power consumption can be reduced.

Further, if, in a period in which the source lines S1–Sn are connected to the capacitor element 351 or 352, or to the opposing electrode 101 (periods T2, T3, T5, T6, and so forth), a drive pulse from the gate driver 200 is applied to the gate line for a set of pixels that are to be subsequently written, for example, to the gate line G2, so as to turn ON the pixel switches T21–T2*n*, then an electric charge can be stored and supplied between the liquid crystal capacitor in each of these pixels and the capacitor elements 351 or 352.

The parasitic capacitance in the source lines S1–Sn is also produced between the source lines S1–Sn and the gate lines G1–Gm. In view of this, in place of connecting the source lines S1–Sn to the opposing electrode 101, the source lines S1–Sn may be connected to the gate lines G1–Gm to prevent an increase in power consumption caused by the foregoing parasitic capacitance. In this case, however, it is necessary to provide transfer gates similar to the above-described DAC-connecting transfer gates 321–32*n* in order to disconnect the gate driver 200 from the gate lines G1–Gm, and it is necessary that, when a plurality of gate lines G1–Gm are connected to the source lines S1–Sn, the pixel switches T11–Tmn be such that they enter the OFF state when the source-gate voltage is 0 V.

Figure 5:
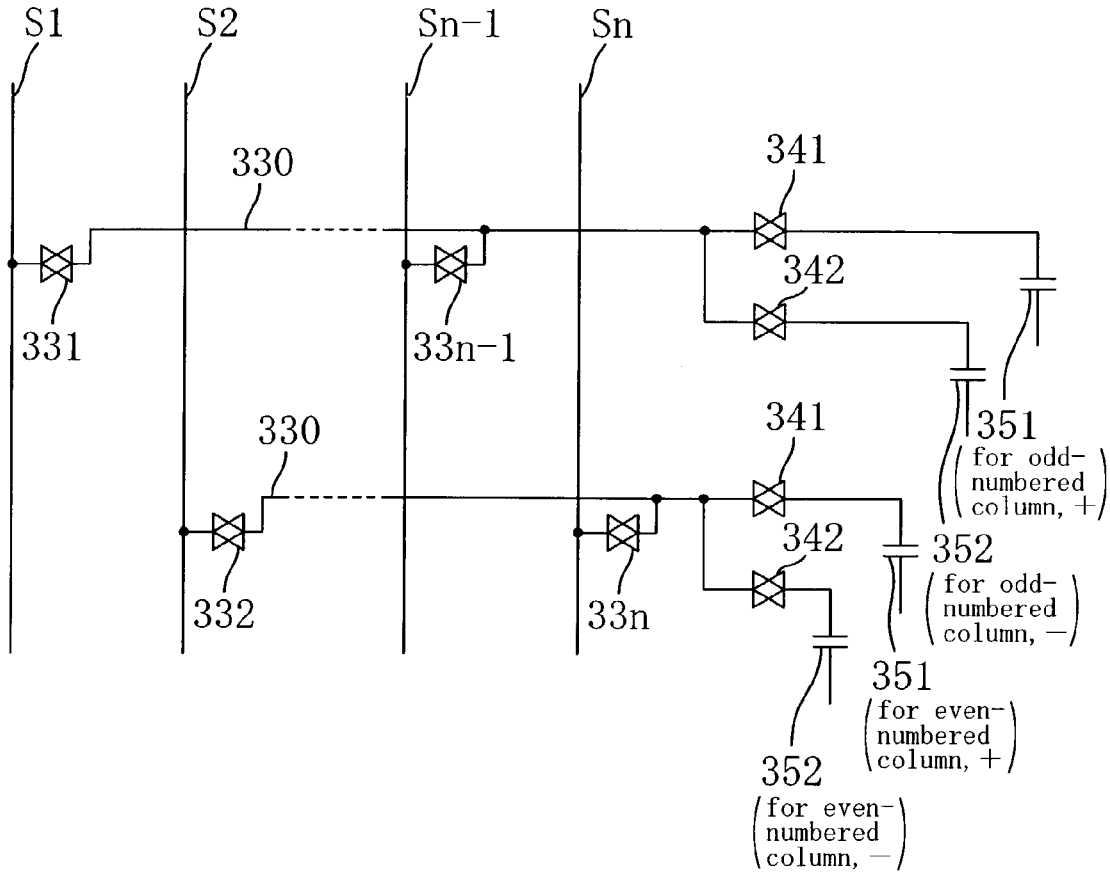
FIG. 5 is a circuit diagram showing a primary portion of another variation of the liquid crystal display device according to Embodiment 1.

Further, in addition to the line inversion drive as described above, a column inversion drive may be employed, in which image signal voltages with opposite polarities are applied to the source lines S1–Sn that are adjacent to each other. If this is desired, the desired effect can be obtained by, for example, providing the source line-connecting line 330, the transfer gates 331–33*n* for a connecting line, the capacitor elements 351 and 352, and the like separately for each of odd numbered columns and even numbered columns, as shown in FIG. 5.

In addition to connecting the source lines S1–Sn to only one of the positive polarity capacitor element 351 and the negative polarity capacitor element 352 every time each line of the pixel electrodes P11–Pmn are written in the manner described above, it is also possible to connect the source lines S1–Sn to one of the capacitor elements, thereafter to the opposing electrode 101, and subsequently to the other capacitor element. In this case, although the number of steps required increases between the time at which voltages are applied from the D-A converters 311–31*n* and the time at which the subsequent voltages are applied, an electric charge can be more efficiently stored into and supplied from the capacitor elements 351 and 352, and as a result, power consumption can be reduced further.

Also, if both terminals of one capacitor element are switched so that they are alternately connected in place of connecting the two capacitor elements 351 and 352 sequentially, the one capacitor element can serve as both the positive polarity capacitor element 351 and the negative polarity capacitor element 352. As a result, it also becomes possible to reduce the circuit scale. The reduction of the circuit scale achieved by switching both terminals of one capacitor element so that they are alternately connected is also effective even when the source lines are not connected to the opposing electrode 101.

Embodiment 2

Embodiment 2 of the present invention describes a liquid crystal panel driving device that can further reduce power consumption. For convenience in description, Embodiment 2 describes a case in which two kinds of voltages having the same polarity with respect to the polarity of the opposing electrode 101 but having different voltages, a relative high voltage and a relative low voltage, are applied to the pixel electrodes P11–Pmn so that a binary level image is displayed. In addition, the shift of electric charge is assumed to be a shift of positive charge for simplicity in description. It should be noted that in the following embodiments, similar components and elements having similar functions to the components and elements described in the foregoing Embodiment 1 and so forth are designated by the same reference characters, and will not be further elaborated upon.

Figure 6:
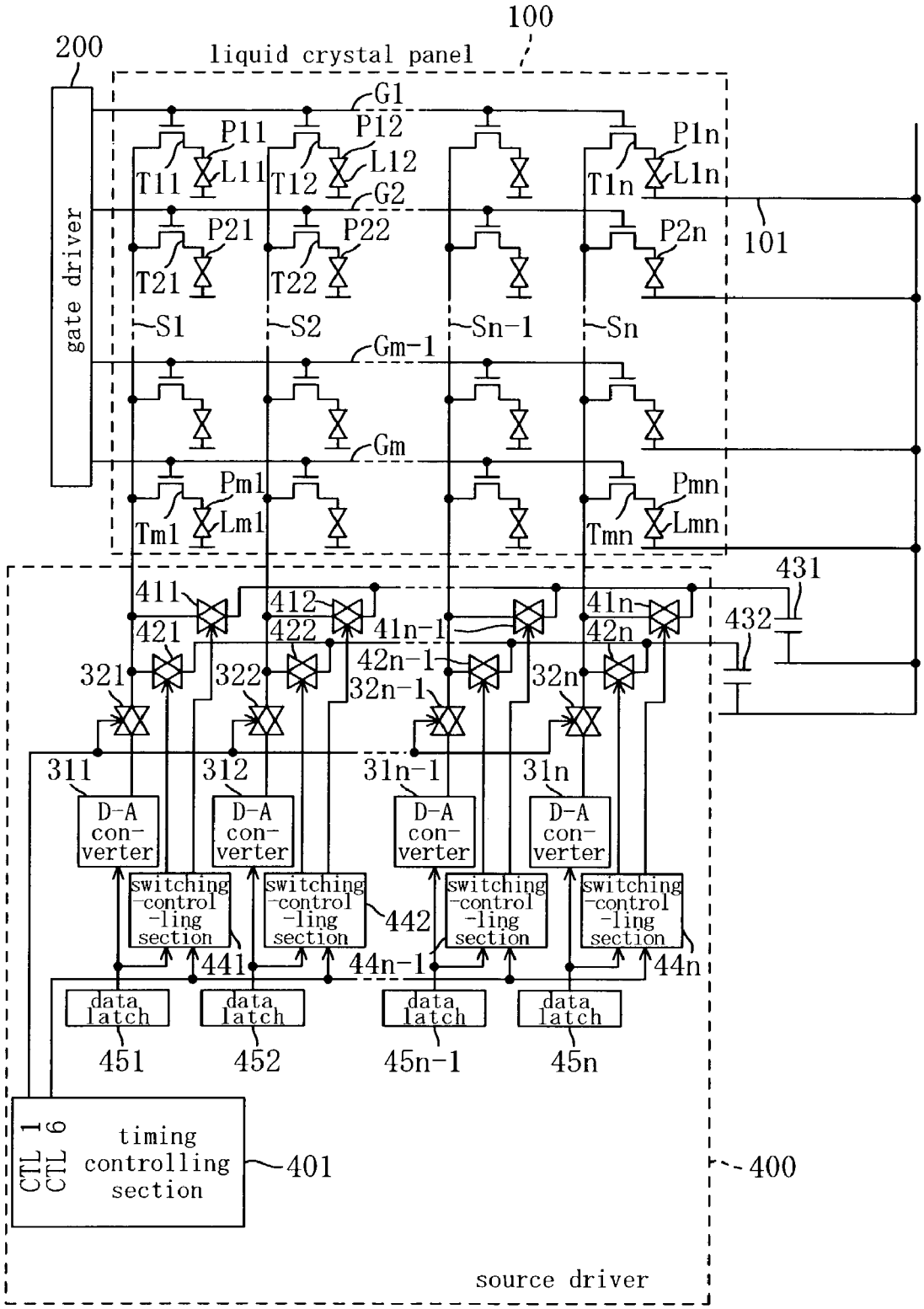
FIG. 6 is a circuit diagram showing the configuration of a liquid crystal display device according to Embodiment 2.

FIG. 6 is a circuit diagram schematically showing the configuration of a primary portion of a liquid crystal display device comprising a source driver (liquid crystal panel driving device) 400 according to Embodiment 2.

In the source driver 400, the source lines S1–Sn are connected to a capacitor element 431 for high voltages through transfer gates 411–41*n* for high voltages, and the source lines S1–Sn are also connected to a capacitor element 432 for low voltages through transfer gates 421–42*n* for low voltages. The transfer gates 411–41*n* for high voltages and the transfer gates 421–42*n* for low voltages are controlled by switching-controlling sections 441–44*n*. That is, the present embodiment is similar to one variation of the foregoing embodiment 1 (shown in FIG. 3) in that the source lines S1–Sn are connected to the capacitor elements 431 and 432 through the transfer gates 411–41*n* and 421–42*n*, respectively, but it greatly differs therefrom in that the transfer gates 411–41*n* and 421–42*n* are individually controlled by the switching-controlling sections 441–44*n*.

Figure 7:
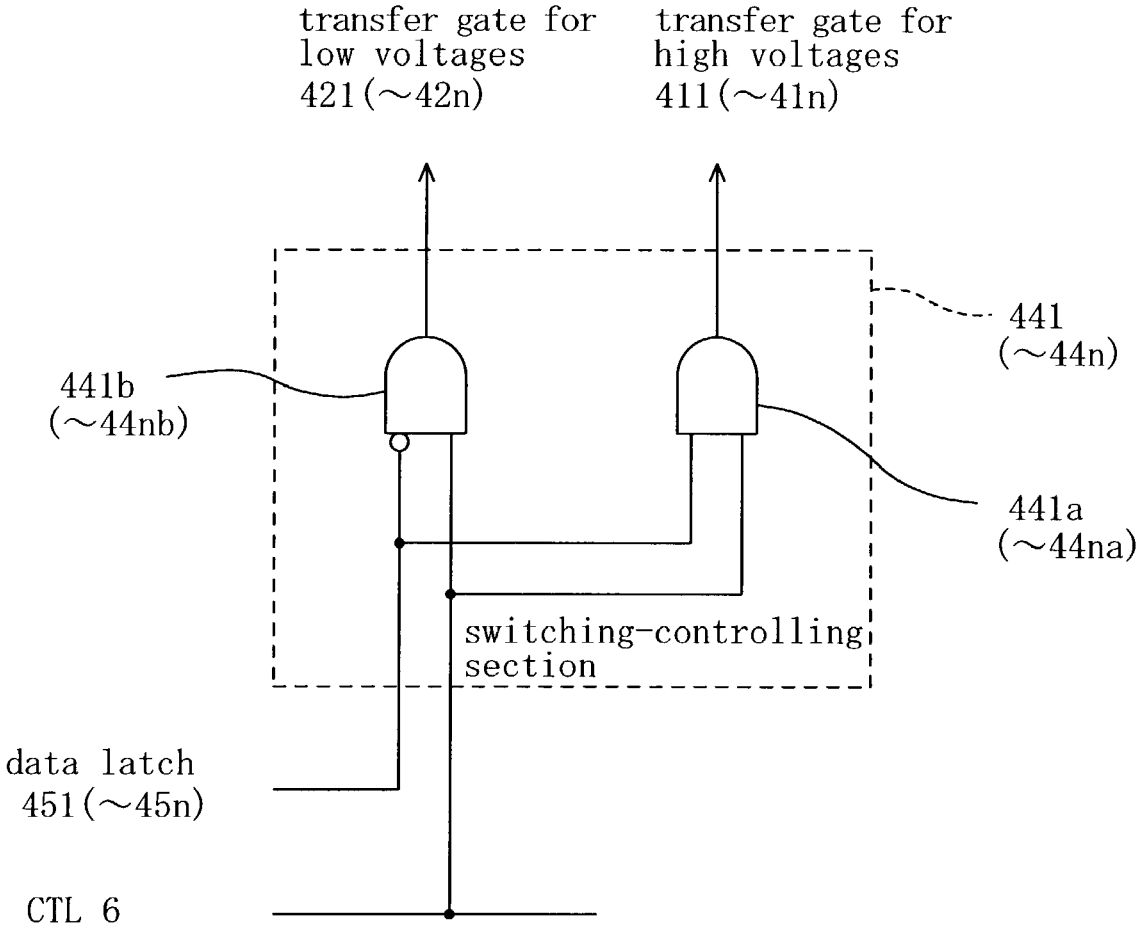
FIG. 7 is a circuit diagram showing the configuration of the switching controlling section.

The switching-controlling sections 441–44*n* comprises, for example as shown in FIG. 7, pairs of AND circuits 441*a* to 44*na* and 441*b* to 44*nb*. The switching-controlling sections 441–44*n* are configured so as to selectively turn ON the transfer gates 411–41*n* for high voltages or the transfer gates 421–42*n* for low voltages according to a control signal CTL6 and image data signals that are input from data latches 451–45*n* to the D-A converters 311–31*n*. The timing controlling section 401 outputs the control signals CTL1 and CTL6.

Figure 8:
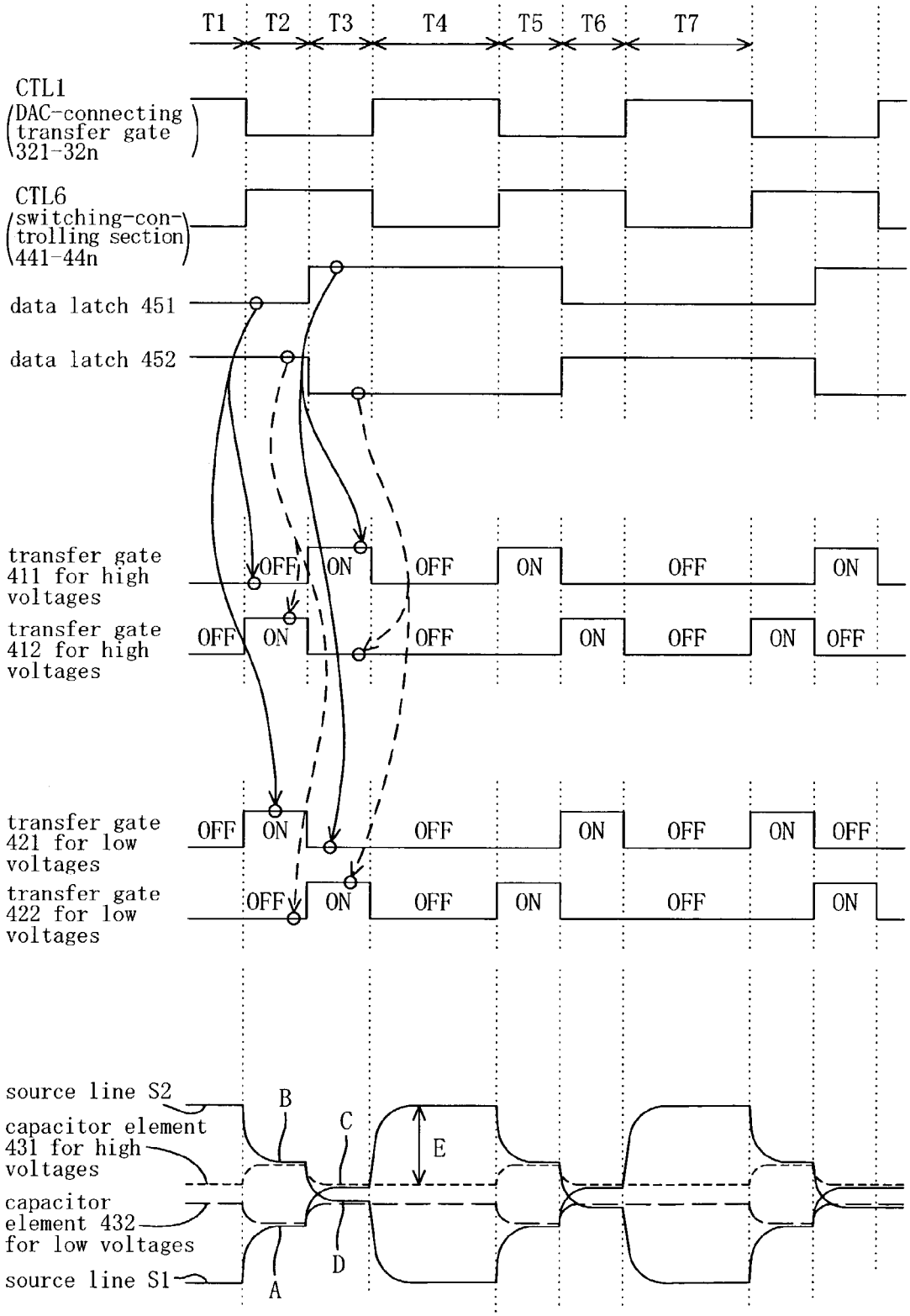
FIG. 8 is a timing chart showing the operation of the liquid crystal display device.

In the liquid crystal display device thus configured, image signal voltages corresponding to image data are retained (written) in between the pixel electrodes P11–Pmn and the opposing electrode 101 by the operation according to changes in the control signals as shown in FIG. 8, which will be described in the following. In the following, a "checkerboard" pattern image, in which a black pixel and a while pixel alternately appear every other row and every other column of pixels, is taken as an example of an image displayed on the device.

Period T1

Figure 2:
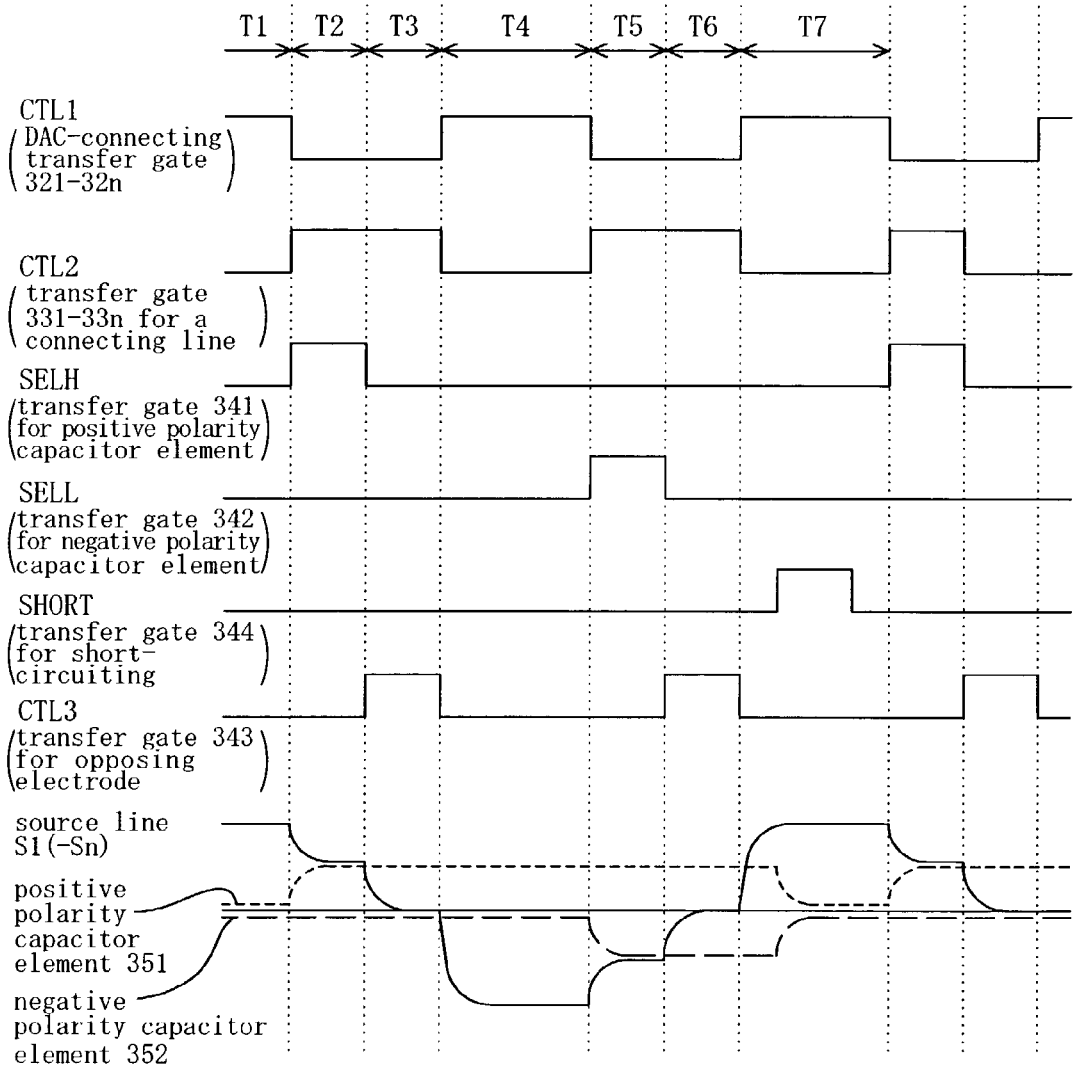
FIG. 2 is a timing chart showing the operation of the liquid crystal display device.

In this period, the pixel electrodes P11–P1*n*, for example, are written in a similar manner to that described in Embodiment 1 (shown in FIG. 2). More specifically, image signal voltages corresponding to image data signals that are output from the data latches 451–45*n* are output from the D-A converters 311–31*n*. At the same time, CTL1 becomes an H level, turning ON the DAC-connecting transfer gates 321–32*n*, and consequently, the image signal voltages are applied to the source lines S1–Sn. At that time, the gate line G1 is driven to an H level, turning ON the pixel switches T11–T1*n*, and the image signal voltages are applied to the pixel electrodes P11–P1*n* and are retained in the liquid crystal capacitance between each of the pixel electrodes P11–P1*n* and the opposing electrode 101. Meanwhile, in this period T1, CTL6 is at an L level. Accordingly, the AND circuits 441*a* to 44*na* and 441*b* to 44*nb* of the switching-controlling sections 441–44*n* output L-level signals regardless of the image data signals that are output from the data latches 451–45*n*, and consequently, both of the transfer gates 411–41*n* for high voltages and the transfer gates 421–42*n* for low voltages are turned OFF.

Period T2

Next, when CTL1 becomes an L level and CTL6 becomes an H level, the DAC-connecting transfer gates 321–32*n* are turned OFF and either the transfer gates 411–41*n* for high voltages or the transfer gates 421–42*n* for low voltages are turned ON according to the image data signals from the data latches 451–45*n*. Accordingly, the source lines S1–Sn are connected to either the capacitor element 431 for high voltages or the capacitor element 432 for low voltages.

More specifically, in the example shown in FIG. 8, the output from the data latch 451 is at an L level, for example. Accordingly, the AND circuit 441*a* of the switching-controlling section 441 outputs an L-level signal, turning OFF the transfer gate 411 for high voltages, while the AND circuit 441*b* outputs an H-level signal, turning ON the transfer gate 421 for low voltages. Consequently, the source line S1 is connected to the capacitor element 432 for low voltages. At that time, the positive charge stored in the capacitor element 432 for low voltages is supplied to the source line S1, increasing the potential of the source line S1 (symbol A in FIG. 8).

Meanwhile, the output from the data latch 452 is at an H level, for example. Accordingly, the AND circuit 442*a* of the switching-controlling section 442 outputs an H level-signal, turning ON the transfer gate 412 for high voltages, while the AND circuit 442*b* outputs an L-level signal, turning OFF the transfer gate 422 for low voltages. Consequently, the source line S2 is connected to the capacitor element 431 for high voltages. At that time, the positive charge retained in the source line S2 is shifted into the capacitor element 431 for high voltages and stored therein, and the potential of the source line S2 is reduced (symbol B in FIG. 8).

Period T3

Thereafter, when a latch signal, which is not shown in the figure, is input into to the data latches 451–45*n* while CTL1 is maintained at an L level and CTL6 at an H level, the image data signals for the pixels corresponding to the next gate line G2 are latched and input to the switching-controlling sections 441–44*n*. (It should be noted that the above-mentioned latched image signals are also input to the D-A converters 311–31*n*, but they do not affect the potentials of the source lines S1–Sn since the DAC-connecting transfer gates 321–32*n* remain OFF.)

Accordingly, in the example shown in FIG. 8, for example, the signal latched by and output from the data latch 451 is at an H level, the AND circuit 441*a* of the switching-controlling section 441 outputs an H-level signal, turning ON the transfer gate 411 for high voltages. Meanwhile, the AND circuit 441*b* outputs an L-level signal, turning OFF the transfer gate 421 for low voltages. Consequently, the source line S1 is connected to the capacitor element 431 for high voltages. At that time, the positive charge stored in the capacitor element 431 for high voltages is supplied to the source line S1, further increasing the potential of the source line S1 (symbol C in FIG. 8).

Meanwhile, the output from the data latch 452 is at an L level. Accordingly, the AND circuit 442*a* of the switching-controlling section 442 outputs an L-level signal, turning OFF the transfer gate 412 for high voltages, while the AND circuit 442*b* outputs an H-level signal, turning ON the transfer gate 422 for low voltages. Consequently, the source line S2 is connected to the capacitor element 432 for low voltages. At that time, the positive charge retained in the source line S2 is shifted into the capacitor element 432 for low voltages and stored therein, and the potential of the source line S2 further reduces (symbol D in FIG. 8).

Period T4

The pixel electrodes P21–P2*n* are written in a similar manner to that described in the period T1 above. Specifically, CTL6 becomes an L level, turning OFF all the transfer gates 411–41*n* and 421–42*n*. Meanwhile, CTL1 becomes an H level, turning ON the DAC-connecting transfer gates 321–32*n*, and the image signal voltages that are output from the D-A converters 311–31*n* are applied to the source lines S1–Sn.

More specifically, for example, the output from the data latch 451 is at an H level, and accordingly, a high voltage is applied to the source line S1 and the pixel electrode P21. Here, the potential of the source line S1 is increased in the periods T2 and T3, for example as described above (symbol C in FIG. 8), and therefore, it is sufficient that the D-A converter 311 supplies only the electric charge that corresponds to the potential difference indicated by symbol E in FIG. 8.

Period T5 Onward

Thereafter, the same operation as in the above-described periods T2 through T4 are repeated, and thereby, the image signal voltages that are output from the D-A converters 311–31*n* are sequentially applied to the pixel electrodes P11–Pmn corresponding to the gate lines G1–Gm; consequently, an image for one screen frame is displayed.

As in the above-described periods T2 and T5, when the source lines S1–Sn are selectively connected to the capacitor element 431 for high voltages or the capacitor element 432 for low voltages according to the potentials of the source lines S1–Sn, in other words, according to the voltages that have been applied to the pixel electrodes P11–Pmn most recently, an electric charge can be stored into the capacitor element 431 for high voltages and an electric charge can be supplied from the capacitor element 432 for low voltages without causing an unnecessary shift of electric charge between the source lines S1–Sn. More specifically, the electric charge retained in the source lines S1–Sn that are at high potentials is stored into the capacitor element 431 for high voltages, and the potentials of the source lines S1–Sn that are at low potentials are increased by an electric charge supplied from the capacitor element 432 for low voltages. In addition, as in the subsequent periods T3 and T6, by being selectively connected to the capacitor element 431 for high voltages or the capacitor element 432 for low voltages according to the voltages next applied to the source lines S1–Sn, those source lines S1–Sn to which high voltages are applied next are supplied with an electric charge by the capacitor element 431 for high voltages and the potentials thereof are further increased, whereas the electric charge stored in those source lines S1–Sn to which low voltages are applied next is stored into the capacitor element 432 for low voltages. Accordingly, power consumption can be reduced by effectively storing and utilizing the electric charge retained in the source lines S1–Sn.

It should be noted that the above-described example describes a case where the invention is applied to a liquid crystal display device that displays binary level images, but the invention is also applicable to devices that display multi-level images. If this is desired, the signal that is input to the switching-controlling sections 441–44*n* may be a signal of the most significant bit (MSB) of the image data. It is also possible that three or more capacitor elements are provided, and, by using a signal of a plurality of more significant bits of the image data, in other words, by dividing an applied voltage into a plurality of groups, the source lines S1–Sn are connected to one of the capacitor elements corresponding to each group. Accordingly, the storing and supplying of an electric charge is more efficiently carried out.

Figure 9:
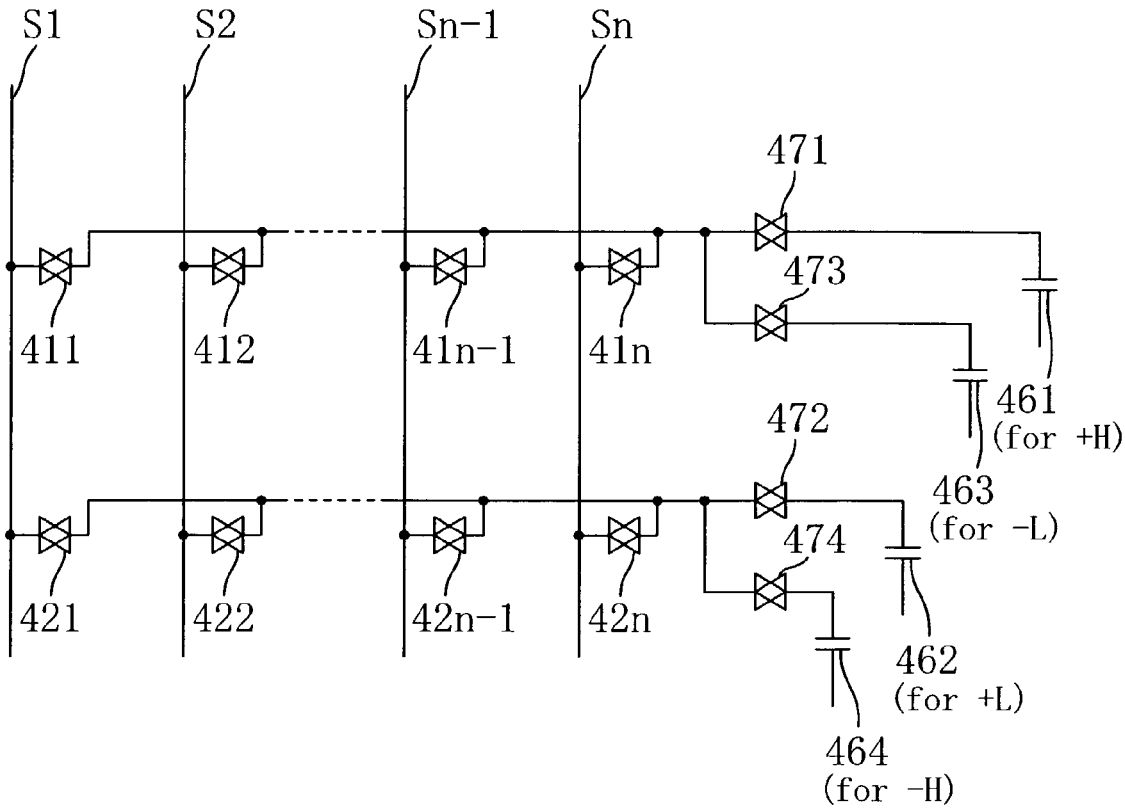
FIG. 9 is a circuit diagram showing a primary portion of a variation of the liquid crystal display device according to Embodiment 2.

The foregoing shows an example in which voltages having the same polarity as that of the opposing electrode 101 are applied to the pixel electrodes P11–Pmn, but as in Embodiment 1, the invention is also applicable to cases where line inversion drive is employed in which the polarities are reversed for the pixels that corresponds to the gate lines G1–Gm adjacent to each other. In other words, the case where the line inversion drive is used for displaying binary level images can be considered as similar to the case where four-level images are displayed. For example, assuming that the potential of the opposing electrode is assumed to be 8 V and that:

+H=16 V,
+L=9 V,
−L=7 V, and
−H=0 V, if a capacitor element 461 for +H, a capacitor element 462 for +L, a capacitor element 463 for −L, a capacitor element 464 for −H, and transfer gates 471–474 are provided and the source lines S1–Sn are connected to receive the foregoing voltages −H, −L, −L, and −H, respectively, as shown in FIG. 9, then power consumption can be reduced in both cases in which the potential of an image signal is higher and lower than the potential of the opposing electrode, according to the same mechanism as that described above.

Further, if a column inversion drive, in which image signal voltages having opposite polarities are applied to the source lines S1–Sn adjacent to each other, is employed, it is sufficient that the source lines S1–Sn are connected to the corresponding capacitor elements according to the polarity and whether the voltage is high or low in a similar manner.

Embodiment 3

Embodiment 3 according to the present invention describes a liquid crystal panel driving device that is capable of further reducing power consumption. This Embodiment 3 also describes, as well as the foregoing Embodiment 2, a case in which two kinds of voltages having the same polarity with respect to the polarity of the opposing electrode 101 but having a relative high voltage and a relative low voltage are applied to the pixel electrodes P11–Pmn so that a binary level image is displayed.

Figure 10:
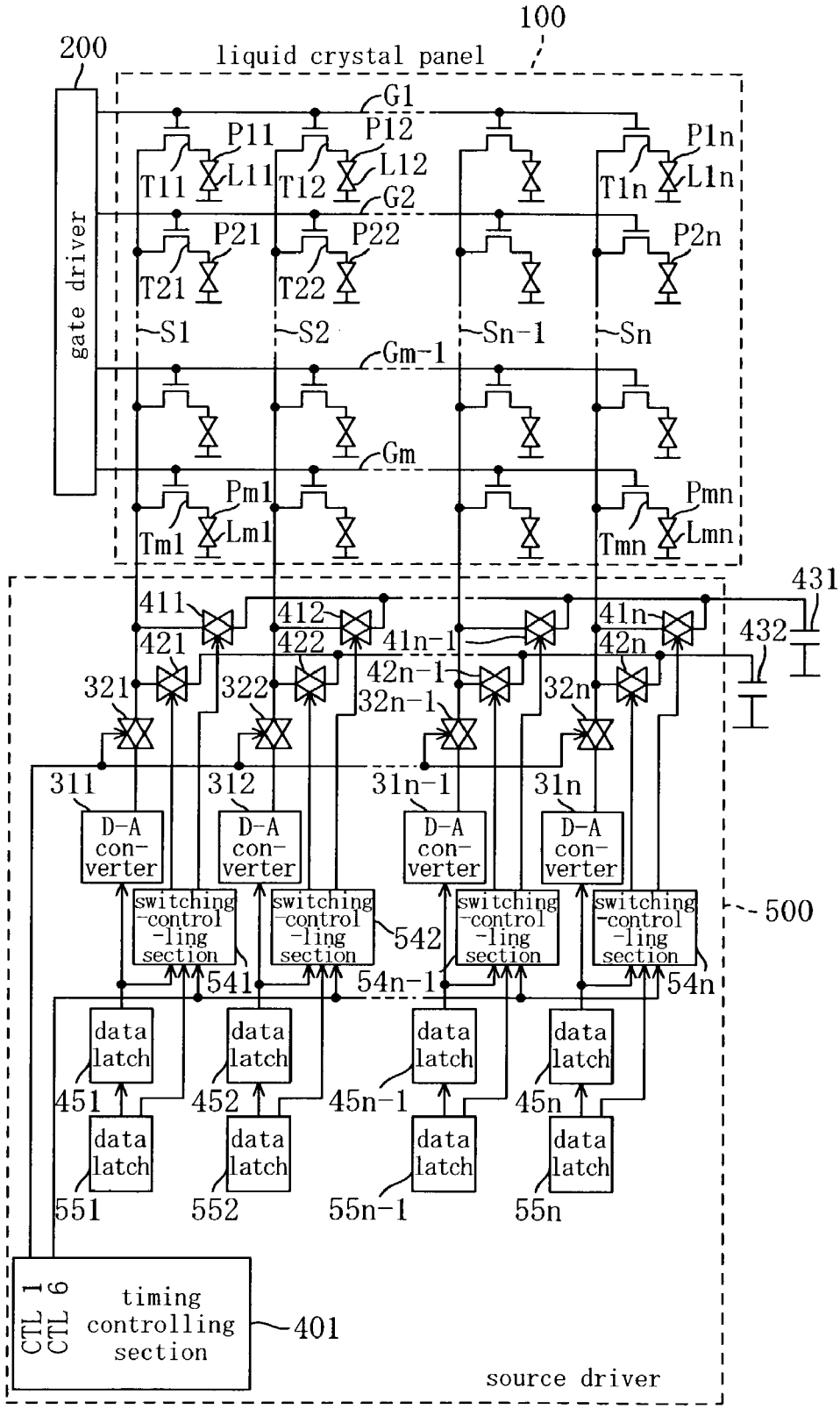
FIG. 10 is a circuit diagram showing the configuration of a liquid crystal display device according to Embodiment 3.

FIG. 10 is a circuit diagram schematically showing the configuration of a primary portion of a liquid crystal display device that includes a source driver (liquid crystal panel driving device) 500 according to Embodiment 3.

The source driver 500 differs from the source driver 400 of Embodiment 2 in that it comprises switching-controlling sections 541–54*n* in place of the switching-controlling sections 441–44*n* and that it comprises data latches 551–55*n* in addition to the data latches 451–45*n*. The data latches 551–55*n* hold image data that are input from the data latches 451–45*n* to the D-A converters 311–31*n* next.

Figure 11:
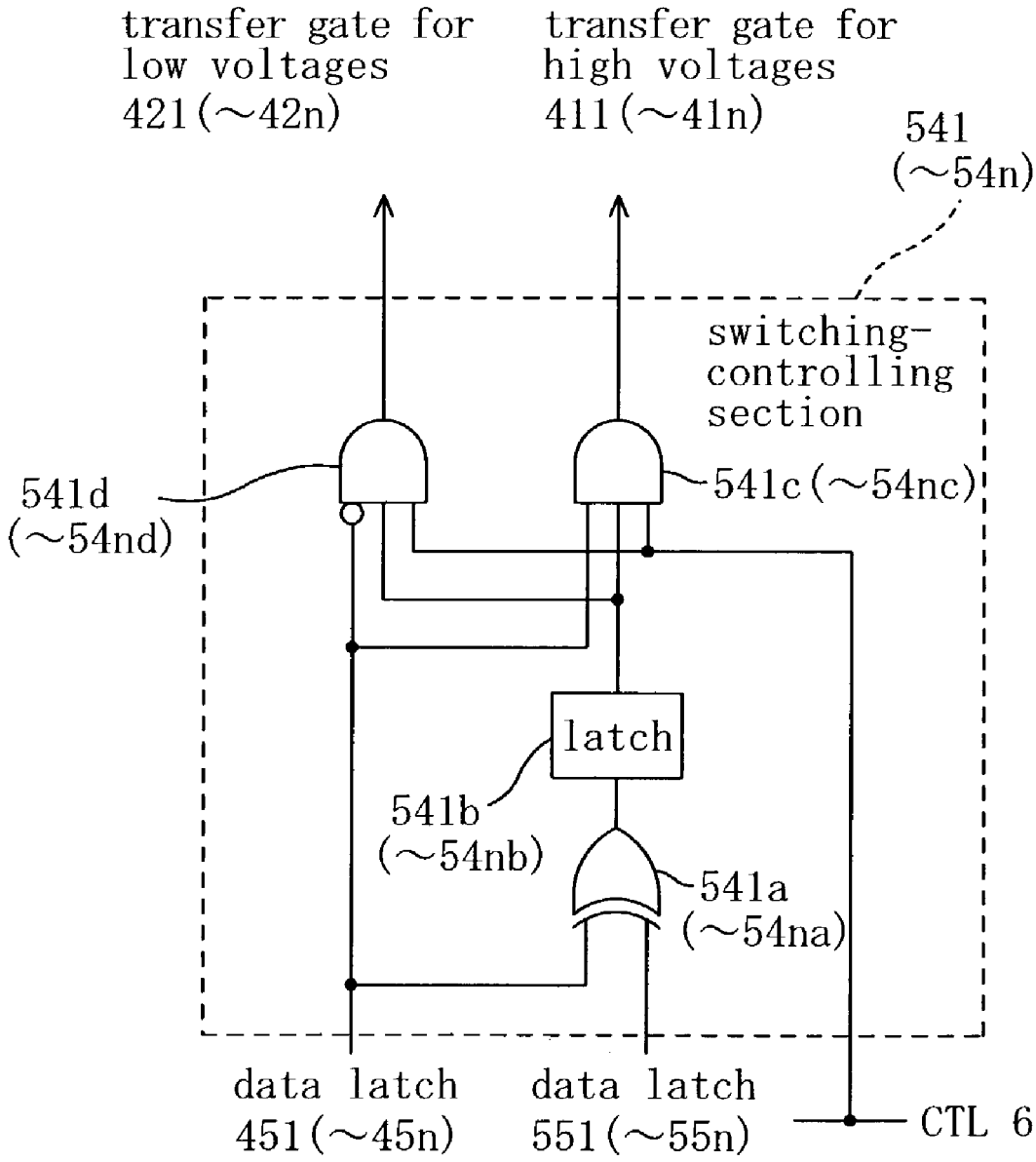
FIG. 11 is a circuit diagram showing the configuration of the switching controlling section.

The switching-controlling sections 541–54*n* comprises, as shown in FIG. 11, for example, NOR circuits 541*a* to 54*na*, latch circuits 541*b* to 54*nb*, and AND circuits 541*c* to 54*nc* and 541*d* to 54*nd*, and they selectively turn ON the transfer gates 411–41*n* for high voltages or transfer gates 421–42*n* for low voltages according to the control signal CTL6 and the image data signals that are input from the data latches 451–45*n* and the data latches 551–55*n*. More specifically, for example, the switching-controlling section 541 turns ON either the transfer gate 411 or the transfer gate 421 for low voltages according to the output from the data latch 451, only when the output from the data latch 451 and the output from the data latch 551 are different.

In the liquid crystal display device thus configured, image signal voltages corresponding to image data are retained (written) in between the pixel electrodes P11–Pmn and the opposing electrode 101 by the operation according to changes in the control signals shown in FIG. 12, which will be described in the following. In the following, a "checkerboard" pattern image, in which a black pixel and a while pixel alternately appear every other row and every other column of pixels, is taken as an example of an image displayed on the device.

Period T1

In this period, the pixel electrodes P11–P1*n*, for example, are written in a similar manner to those described in Embodiments 1 and 2 (shown in FIGS. 2 and 8). Specifically, image signal voltages corresponding to the image data signals that are output from the data latches 451–45*n* are output from the D-A converters 311–31*n*, and at the same time, CTL1 becomes an H level, turning ON the DAC-connecting transfer gates 321–32*n*, and the image signal voltages are applied to the source lines S1–Sn. At that time, the gate line G1 is driven to an H level, turning ON the pixel switches T11–T1*n*, and the image signal voltages are applied to the pixel electrodes P11–P1*n* and are retained in the liquid crystal capacitance between each of the pixel electrodes P11–P1*n* and the opposing electrode 101. Meanwhile, in this period T1, CTL6 is at an L level. Accordingly, the AND circuits 541*a* to 54*na* and 541*b* to 54*nb* of the switching-controlling sections 541–54*n* output L-level signals regardless of the image data signals that are output from the data latches 451–45*n* and the data latches 551–55*n*, and both the transfer gates 411–41*n* for high voltages and the transfer gates 421–42*n* for low voltages are turned OFF. Therefore, none of the source lines S1–Sn is connected to the capacitor element 431 or 432.

Period T2

Next, when CTL1 becomes an L level and CTL6 becomes an H level, the DAC-connecting transfer gates 321–32*n* are turned OFF. At the same time, in such a case as described above where a black pixel and a white pixel appear every other row of pixels vertically adjacent to each other, the transfer gates 411–41*n* for high voltages or the transfer gates 421–42*n* for low voltages are turned ON according to the image data signals from the data latches 451–45*n* and the data latches 551–55*n*. Accordingly, the source lines S1–Sn are connected to either the capacitor element 431 for high voltages or the capacitor element 432 for low voltages.

Figure 12:
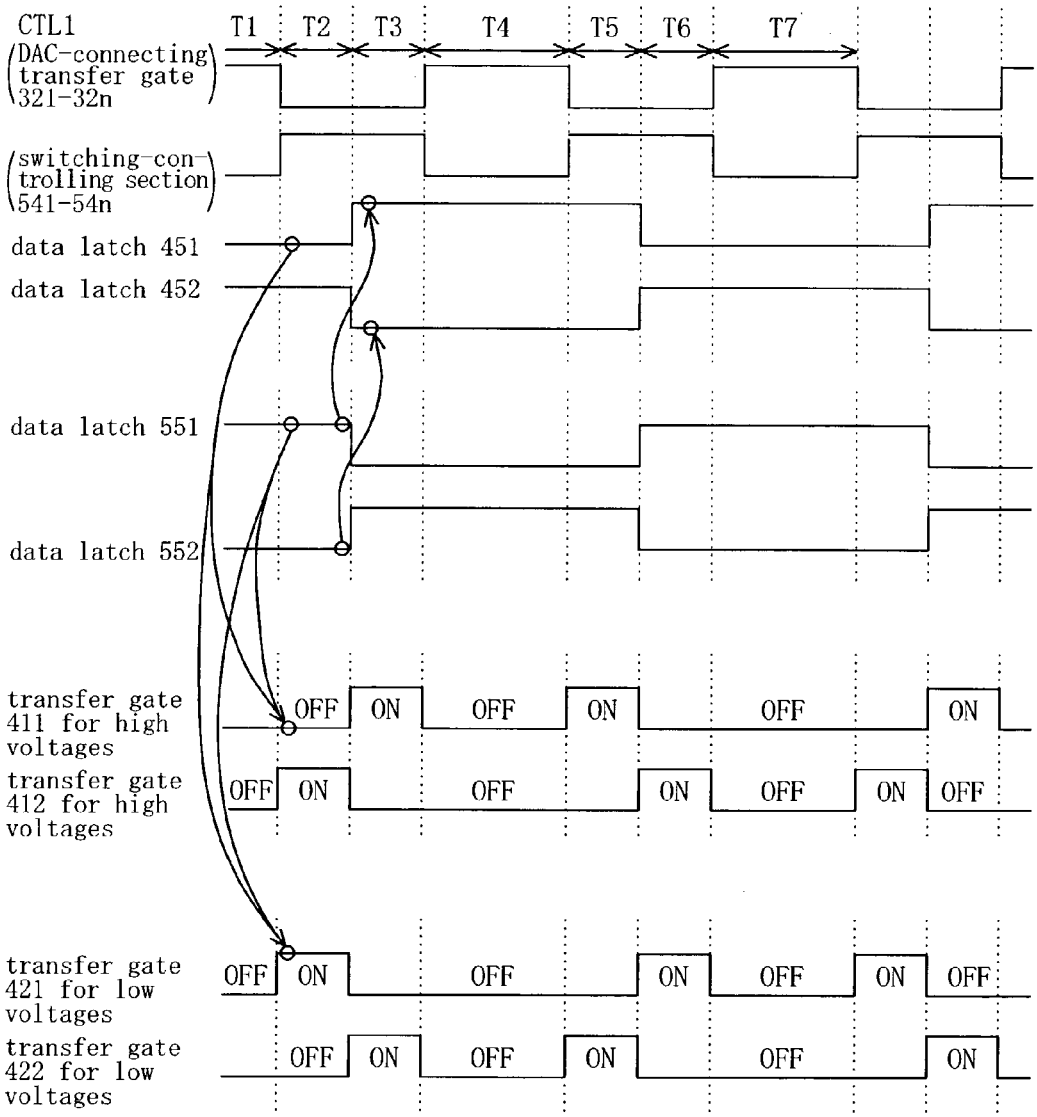
FIG. 12 is a timing chart showing the operation of the liquid crystal display device.

More specifically, in the example shown in FIG. 12, for example, the output from the data latch 451 is at an L level and the output from the data latch 551 is at an H level. Accordingly, when the output from of the NOR circuit 541*a* of the switching controlling section 541 is retained in the latch circuit 541*b* and is output therefrom according to a latch signal, which is not shown in the figure, the AND circuit 541*c* outputs an L-level signal, turning OFF the transfer gate 411 for high voltages, while the AND circuit 541*d* outputs an H level signal, turning ON the transfer gate 421 for low voltages. Consequently, the source line S1 is connected to the capacitor element 432 for low voltages. At that time, the positive charge stored in the capacitor element 432 for low voltages is supplied to the source line S1, increasing the potential of the source line S1.

Meanwhile, the output from the data latch 452 is at an H level and the output from the data latch 552 is at an L level, for example. Accordingly, the AND circuit 542*c* of the switching-controlling section 542 outputs an H level signal, turning ON the transfer gate 412 for high voltages, while the AND circuit 542*d* outputs an L level, turning OFF the transfer gate 422 for low voltages. Consequently, the source line S2 is connected to the capacitor element 431 for high voltages. At that time, the positive charge retained in the source line S2 is shifted into the capacitor element 431 for high voltages and stored therein, and the potential of the source line S2 reduces.

In other words, when the applied voltages change from low voltages to high voltages, the source lines S1–Sn are connected to the capacitor element 432 for low voltages so that they are supplied with the electric charge retained in the capacitor element 432 for low voltages. When the applied voltages change from high voltages to low voltages, the source lines S1–Sn are connected to the capacitor element 431 for high voltages so that the electric charge retained in the source lines S1–Sn is stored in the capacitor element 431 for high voltages. By contrast, when the voltages applied to the source lines S1–Sn do not change (when the displayed image does not have a "checkerboard"-like pattern), the outputs from the NOR circuits 541*a* and so forth of the switching-controlling sections 541–54*n* (i.e., the outputs from the latch circuits 541*b* and so forth) become an L level regardless of whether the applied voltages are high voltages or low voltages. Consequently, the source lines S1–Sn are not connected to either of the capacitor element 431 or 432, and the voltages are maintained at the same level. Therefore, for those source lines S1–Sn, an unnecessary shift of electric charge does not occur, and as a result, the efficiency in utilizing the electric charge improves.

Period T3

Thereafter, when CTL1 is maintained at an L level and CTL6 at an H level, a latch signal, which is not shown in the figure, is input into the data latches 451–45*n* and the data latches 551–55*n*. Then, the image data signals that have been retained by the data latches 551–55*n* for the pixels corresponding to the next gate line G2 are latched by the data latches 451–45*n* and input into the switching-controlling sections 541–54*n*. Then, the data latches 551–55*n* latch the further next image data signals. (It should be noted that the latch timing for the data latches 551–55*n* is not necessarily the same timing as that for the data latches 451–45*n*, but it may be other timing as long as it is before the data latches 451–45*n* perform a subsequent latch operation.)

At that time, in the example shown in FIG. 12; for example, the signal latched by the data latch 451 and output therefrom becomes an H level. Accordingly, the AND circuit 541*c* of the switching-controlling section 541 outputs an H-level signal, turning ON the transfer gate 411 for high voltages, while the AND circuit 541*d* outputs an L-level signal, turning OFF the transfer gate 421 for low voltages. Consequently, the source line S1 is connected to the capacitor element 431 for high voltages. At that time, the positive charge stored in the capacitor element 431 for high voltages is supplied to the source line S1, and the potential of the source line S1 is further increased.

Meanwhile, the output from the data latch 452 becomes an L level. Accordingly, the AND circuit 542*c* of the switching-controlling section 542 outputs an L-level signal, turning OFF the transfer gate 412 for high voltages, while the AND circuit 542*d* outputs an H-level signal, turning ON the transfer gate 422 for low voltages. Consequently, the source line S2 is connected to the capacitor element 432 for low voltages. At that time, the positive charge retained in the source line S2 is shifted and stored into the capacitor element 432 for low voltages, and the potential of the source line S2 is further reduced.

For those source lines S1–Sn in which the voltages to be applied next do not change from the previous ones, the outputs from the latch circuits 541*b*–54*nb* are maintained at an L level. Consequently, those source lines are not connected to either of the capacitor element 431 or 432, and are maintained at the same voltage level. As a result, in those source lines S1–Sn, an unnecessary shift of electric charge does not occur, and moreover, the electric charge stored in the transfer gate 341 for the positive polarity capacitor element is supplied only to those source lines S1–Sn in which the applied voltages thereto change from low voltages to high voltages. Thus, the electric charge is utilized more efficiently.

Period T4

The pixel electrodes P21–P2*n* are written in a similar manner to that described in the period T1 above. More specifically, CTL6 becomes an L level, turning OFF all the transfer gates 411–41*n* and 421–42*n*. Meanwhile, CTL1 becomes an H level, turning ON the DAC-connecting transfer gates 321–32*n*, and the image signal voltages that are output from the D-A converters 311–31*n* are applied to the source lines S1–Sn.

More specifically, for example, the output from the data latch 451 is at an H level, and accordingly, a high voltage is applied to the source line S1 and the pixel electrode P21. Here, for example, the potential of the source line S1 has already been increased in the periods T2 and T3, as described above, and therefore, it is sufficient that the D-A converter 311 supplies only the electric charge that corresponds to the potential difference between the increased potential and the potential of the output from the D-A converter 311. Moreover, as described above, those source lines S1–Sn in which the voltages to be applied next do not change from the previous ones are not connected to either the capacitor element 431 or 432 in the periods T2 and T3, and the voltages retained therein do not change. Therefore, even when the same voltages are applied from the D-A converters 311–31*n* to the source lines S1–Sn, there is little current flow, and power is not consumed.

Period T5 Onward

Thereafter, the same operation as in the above-described periods T2 through T4 are repeated, and thereby, the image signal voltages that are output from the D-A converters 311–31*n* are sequentially applied to the pixel electrodes P11–Pmn corresponding to the gate lines G1–Gm; consequently, an image for one screen frame is displayed.

As in the above-described periods T2 and T5, only when the voltages applied to the pixel electrodes P11–Pmn most recently are different from the voltages to be applied next, the source lines S1–Sn are selectively connected to the capacitor element 431 for high voltages or the capacitor element 432 for low voltages according to the voltages applied most recently. Therefore, an electric charge can be stored thereto and supplied therefrom without causing an unnecessary shift of electric charge between the source lines S1–Sn or between the source lines S1–Sn and the capacitor elements 431 and 432. In addition, as in the subsequent periods T3 and T6, only when the voltages that have been applied to the pixel electrodes P11–Pmn most recently are different from the voltages that are to be applied thereto next, the source lines are selectively connected to the capacitor element 431 for high voltages or the capacitor element 432 for low voltages according to the voltages to be applied to the source lines S1–Sn next. As a consequence, an electric charge can be stored thereto and supplied therefrom without causing an unnecessary shift of electric charge in these periods as well. Thus, the electric charge retained in the source lines S1–Sn is more effectively stored and utilized so that power consumption can be reduced. Furthermore, those source lines S1–Sn in which the applied voltages do not change are not connected to either the capacitor element 431 or 432, and the same voltages are maintained therein. Therefore, even when voltages are applied from the D-A converters 311–31*n*, there is little current flow, and power is not consumed.

It should be noted that, Embodiment 3 too may be applied to a liquid crystal display device for displaying multi-level images by providing three or more capacitor elements, and it may also be applied to liquid crystal display devices of line inversion type or of column inversion drive type, as described in Embodiment 2 above.

Figure 13:
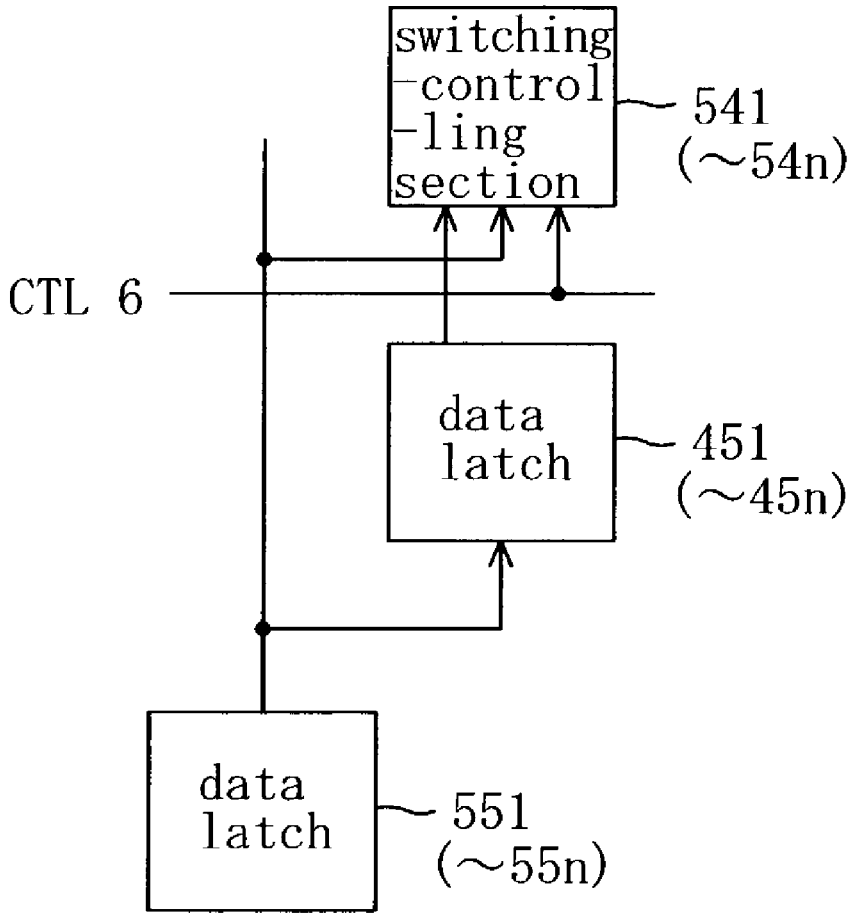
FIG. 13 is a circuit diagram showing the configuration of a primary portion of a variation of the liquid crystal display device according to Embodiment 3.

Furthermore, the circuit configuration is not limited to that described above. For example, as shown in FIG. 13, it is possible to provide the data latches 451–45*n* between the data latches 551–55*n* and the switching-controlling sections 541–54*n*. This configuration is possible, for example, if the values retained by the data latches 451–45*n* and the data latches 551–55*n* are refreshed before the period T2 and only the values retained by the data latches 451–45*n* are refreshed at the period T3.

Embodiment 4

Figure 14:
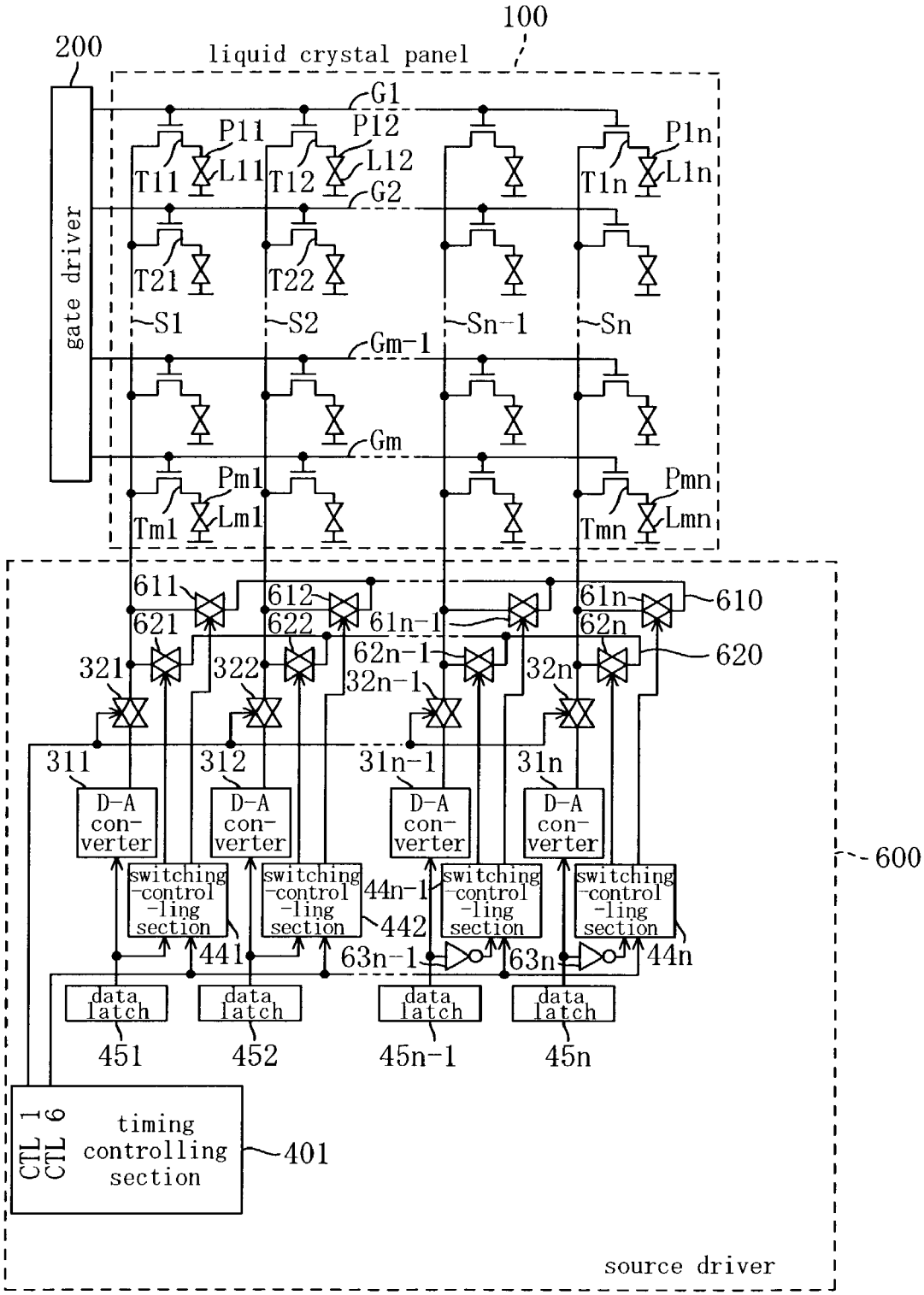
FIG. 14 is a circuit diagram showing the configuration of a liquid crystal display device according to Embodiment 4.

FIG. 14 is a circuit diagram schematically showing the configuration of a primary portion of a liquid crystal display device that includes a source driver (liquid crystal panel driving device) 600 according to Embodiment 4.

Figure 15:
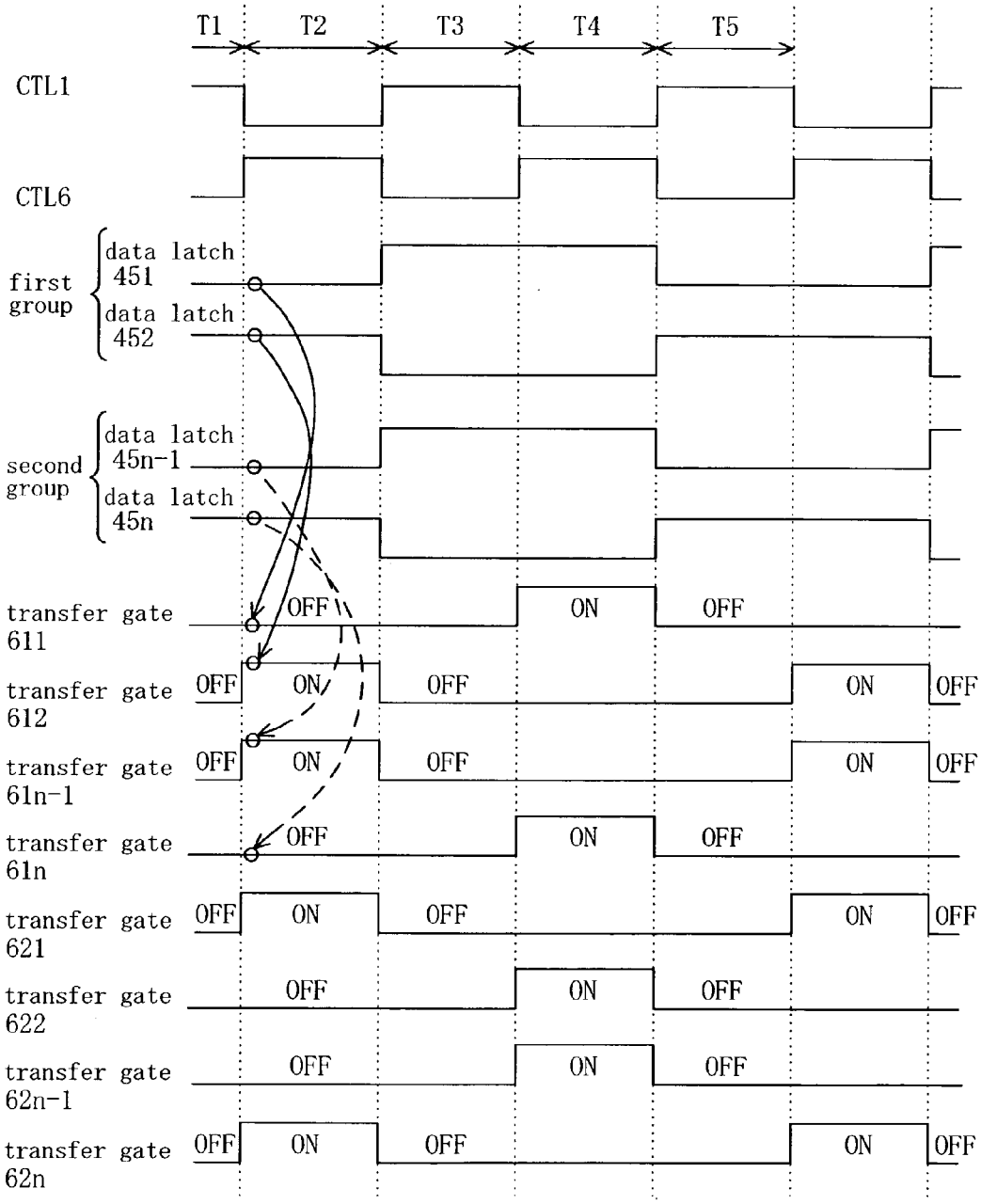
FIG. 15 is a timing chart showing the operation of the liquid crystal display device.

The source driver 600 has a similar configuration to that of Embodiment 2 (shown in FIG. 6). However, no capacitor elements are provided, and the source lines S1–Sn are merely connected to each other through either first transfer gates 611–61*n* or second transfer gates 621–62*n*, and through either a source line-connecting line 610 or a source line-connecting line 620. The source lines S1–Sn are divided into two groups of source lines, a first group and a second group, and those switching-controlling sections 44*n*-1, 44*n*, . . . and so forth that correspond to the second group, for example those source lines Sn-1, Sn, . . . and so forth, are supplied with inverted signals of the outputs from the data latches 45*n*-1, 45*n*, . . . and so forth inverted by NOT circuits 63*n*-1, 63*n*, . . . and so forth. In other words, upon receiving the same image data, each of one group of the source lines S1, . . . and so forth and the other group of the source lines Sn, . . . and so forth is connected to a different one of the source line-connecting line 610 or 620. More specifically, as shown in FIG. 15, for example, the pixel electrodes P11–P1*n* are written in the period T1, as in Embodiment 1 etc. Thereafter, in the period T2, for the first group, when the outputs from the data latches 451, . . . and so forth are at an L level, the first transfer gates 611, . . . and so forth are turned OFF while the second transfer gates 621, . . . and so forth are turned ON. Meanwhile, for the second group, when the outputs from the data latches 45*n*, . . . and so forth are at an L level, the first transfer gates 61*n*, . . . and so forth are turned ON while the second transfer gates 62*n*, . . . and so forth are turned OFF.

This configuration is explained assuming that one display line has 10 pixels, for example, as shown in FIG. 16. In the period T2, the source line(s) corresponding to, among the five pixels on the left, the pixel(s) to which low voltages are applied in the period T1 and the source line(s) corresponding to, among the five pixels on the right, the pixel(s) to which high voltages are applied, are short-circuited together. At the same time, the source line(s) corresponding to, among the five pixels of the left, the pixel(s) to which high voltages are applied in the period T1 and the source line(s) corresponding to, among the five pixels on the right, the pixel(s) to which low voltages are applied, are short-circuited together. Thus, the electric charge retained in source lines is averaged in the source lines that are connected to each other. Now assume that the electric charge retained in a source line to which a high voltage is applied is 6 (the unit here is a unit proportional to Coulomb), the electric charge retained in a source line to which a low voltage is applied is 0, and the voltages as shown in Pattern 1 in the figure are applied. In both periods T1 and T3, the electric charge retained in the third source line from the right is 6, while in the period T2 the electric charge retained in that source line is 1; accordingly, the difference therebetween, which is an electric charge of 5, is to be supplied from the power supply. By contrast, as shown also in the same figure, in the case where all the source lines are short-circuited regardless of the level of the applied voltages in the period T2, the electric charge retained in the third source line from the right is 0.6, and accordingly, an electric charge of 5.4 is to be supplied from the power supply in the period T3. Thus, by short-circuiting the source lines that are grouped in the above-described manner, power consumption can be reduced by an electric charge of 0.4. Also, in the other Patterns 2 through 5 shown in FIG. 16, power consumption can be reduced likewise in comparison with the case where all the source lines are short-circuited.

In this case, depending on display patterns, power consumption may not always reduced by grouping the source lines in the above-described manner. However, as shown in FIG. 16, such display images in which the pixels corresponding to the display lines adjacent to each other show a high correlation are very common in computer screens or the like that extensively use, for example, window displays and line/border displays. Therefore, particularly in the cases of such display images, the present embodiment is effective in reducing power consumption. Moreover, because capacitor elements are unnecessary, the circuit scale can be suppressed. Furthermore, it is sufficient that the first transfer gates 611–61*n* and so forth are maintained to be in a single switching state while CTL1 is at an L level, and this makes it easy to shorten the period of time necessary to display one frame.

The foregoing has described an example in which the pixels in a display line are grouped into two groups that are on the right and on the left, but this example is not meant to limit the embodiment. It is also possible that, for example, the groups may be formed by the pixels of odd numbered columns and the pixels of even numbered columns, and that each group may be made of a plurality of pixels adjacent to each other. It is also possible that each group is formed by pixels located in random positions.

Further, the foregoing has described an example in which some of the switching-controlling sections 44*n*-1, 44*n*, . . . and so forth are supplied with the signals inverted by the NOT circuits 63*n*-1, 63*n*, . . . and so forth, but this is not meant to limit the embodiment either. For example, it is possible to replace the signals output from the switching-controlling sections 44*n*-1, 44*n*, . . . and so forth to the first transfer gates 61*n*-1, 61*n*, . . . and so forth with the signals output to the second transfer gates 62*n*-1, 62*n*, . . . and so forth.

In the present Embodiment 4 as well, three or more source line-connecting lines 610 etc. may be provided so that the invention can be applied to a liquid crystal display device capable of displaying multi-level images. If this is the case, it is possible to control whether the source lines are connected to the source line-connecting line 610, . . . and so forth according to the difference between the voltages that are previously or subsequently applied to the source lines S1–Sn, not according to whether the voltages are the same or not.

Embodiment 5

Figure 17:
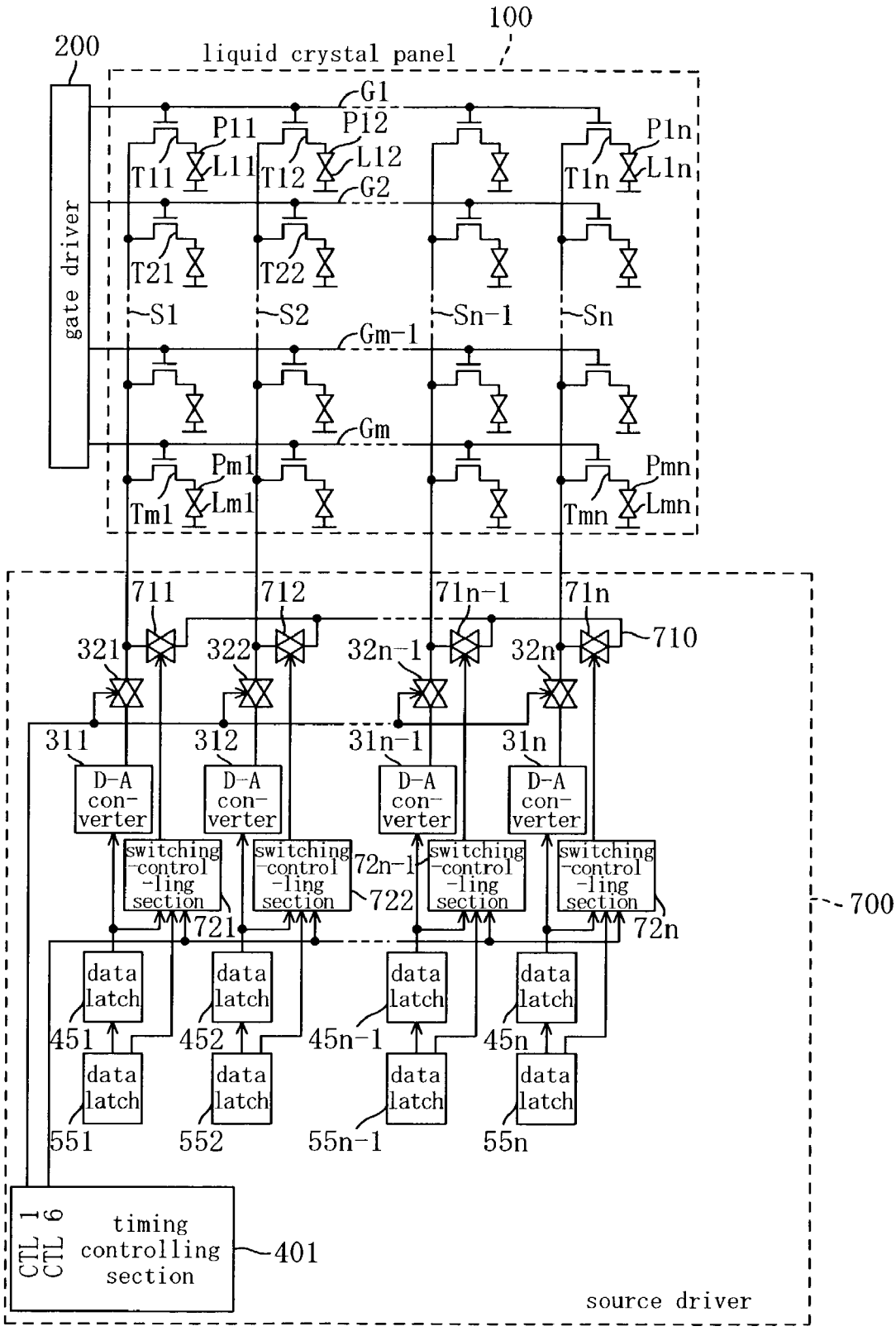
FIG. 17 is a circuit diagram showing the configuration of a liquid crystal display device according to Embodiment 5.

FIG. 17 is a circuit diagram schematically showing the configuration of a primary portion of a liquid crystal display device including a source driver (liquid crystal panel driving device) 700 according to Embodiment 5.

Figure 18:
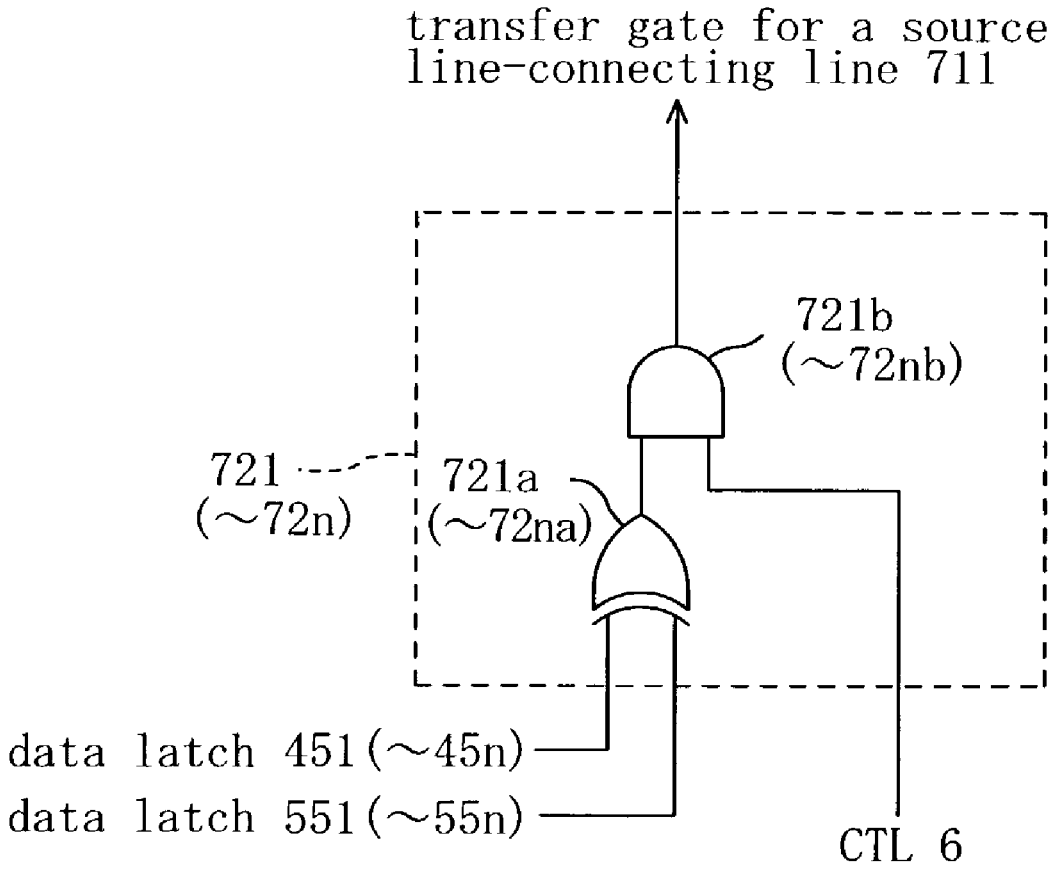
FIG. 18 is a circuit diagram showing the configuration of the switching controlling section.

In the source driver 700, the source lines S1–Sn are connected to each other through the source line-connecting transfer gates 711–71*n* and the source line-connecting line 710. The source line-connecting transfer gates 711–71*n* are controlled by the switching-controlling sections 721–72*n*, respectively. The switching-controlling sections 721–72*n* comprise, as shown in FIG. 18, NOR circuits 721*a*–72*na* and AND circuits 721*b*–72*nb*. The switching-controlling sections 721–72*n* turn ON the source line-connecting transfer gates 711–71*n* when CTL6 is at an H level and the outputs from the data latches 451–45*n* are different from the outputs from the data latches 551–55*n*, that is, only when the voltages applied to the source lines S1–Sn change.

With the above-described configuration, for those source lines S1–Sn in which voltages previously and subsequently applied for writing do not change, the switching-controlling sections 721–72*n* output an L-level signal, turning OFF the source line-connecting transfer gates 711–71*n*. As a consequence, an unnecessary shift of electric charge does not occur between the foregoing source lines S1–Sn and other source lines S1–Sn, and the same level of the voltage retained therein is applied from the D-A converters 311–31*n*. Thus, there is little current flow, and power is not consumed. By contrast, for those source lines S1–Sn in which the applied voltages change, the switching-controlling sections 721–72*n* output an H-level signal, turning ON the source line-connecting transfer gates 711–71*n*, so the source lines are connected to each other through the source line-connecting line 710. Consequently, a shift of electric charge occurs from those source lines S1–Sn with high voltages to those source lines S1–Sn with low voltages, that is, to those source lines S1–Sn to which high voltages are applied next. Thus, it is possible to reduce the current that flows from the power supply when high voltages are applied, and consequently, power consumption is suppressed. Moreover, capacitor elements are unnecessary as in Embodiment 4 above, so the circuit scale is reduced likewise. Furthermore, it is sufficient that the source line-connecting transfer gates 711–71*n* are maintained to be in a single switching state while CTL1 is at L level, and this makes it easy to shorten the period of time necessary to display one frame.

In the present Embodiment 5 as well, in cases of displaying multi-level images, it is possible to control whether or not the source lines are connected to the source line-connecting line 710 according to the difference between the voltages applied previously and subsequently to the source lines S1–Sn.

Figure 19:
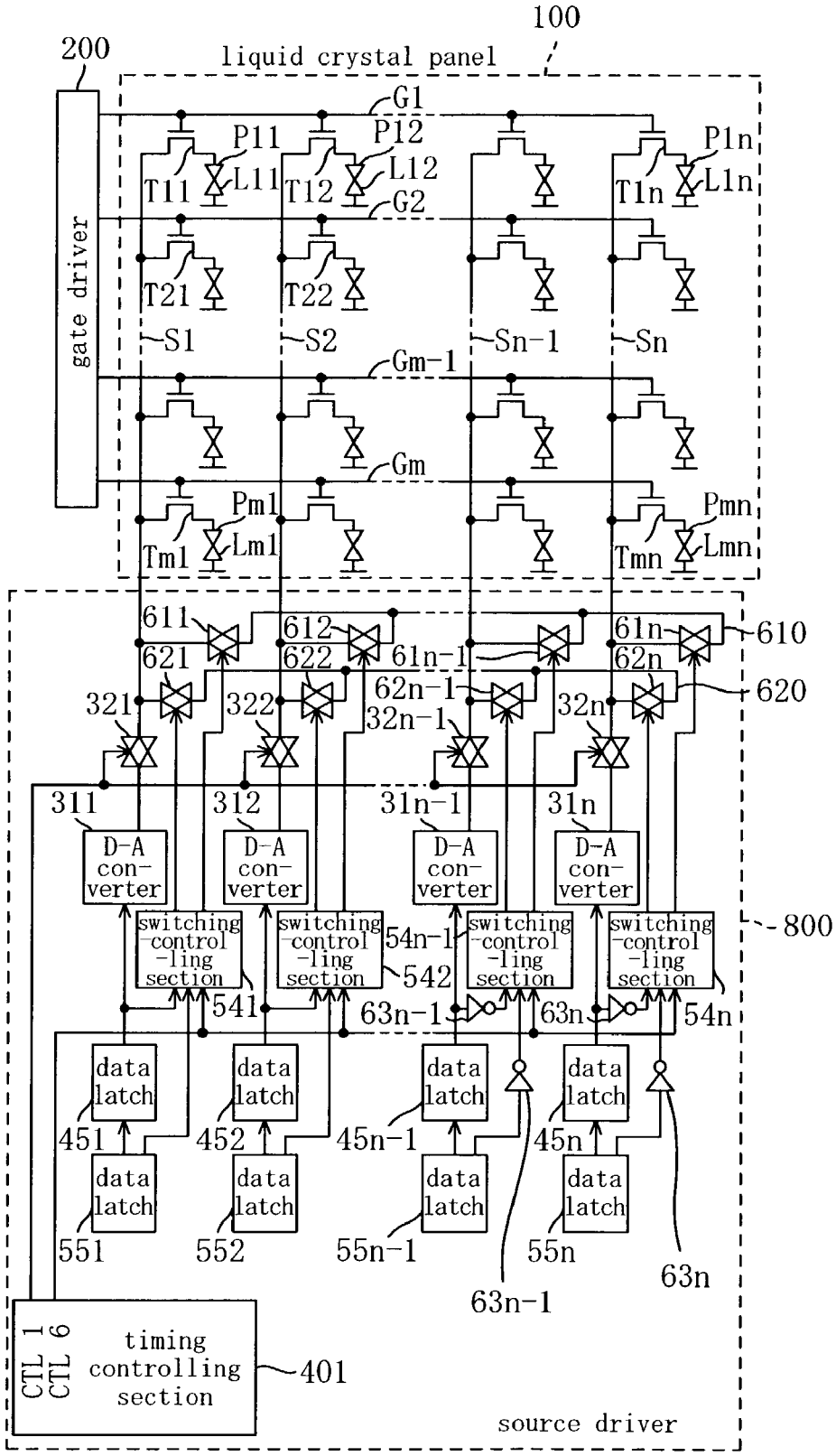
FIG. 19 is a circuit diagram showing the configuration of a variation of the liquid crystal display device according to Embodiment 5.
Figure 20:
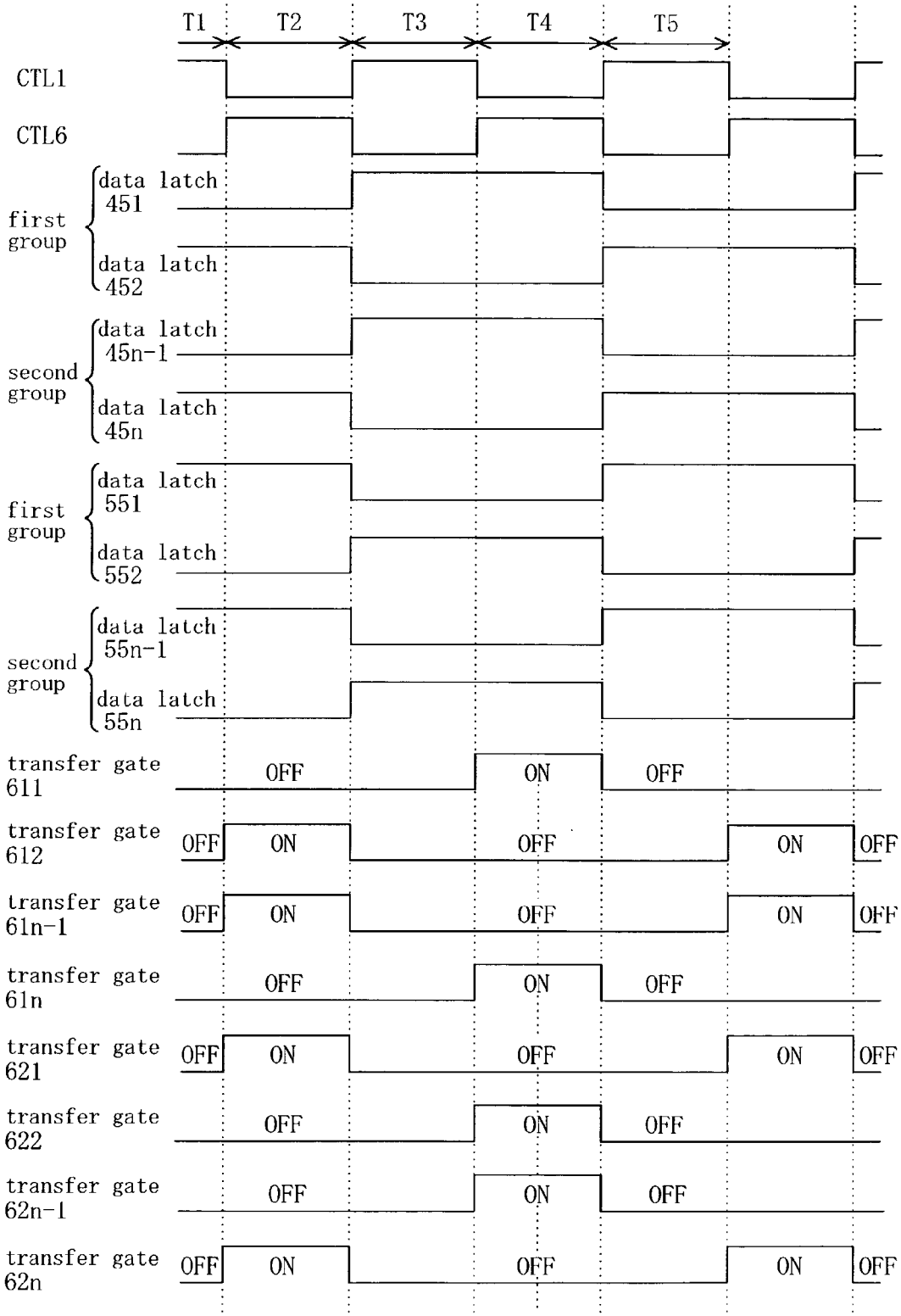
FIG. 20 is a timing chart showing the operation of the liquid crystal display device.
Figure 21:
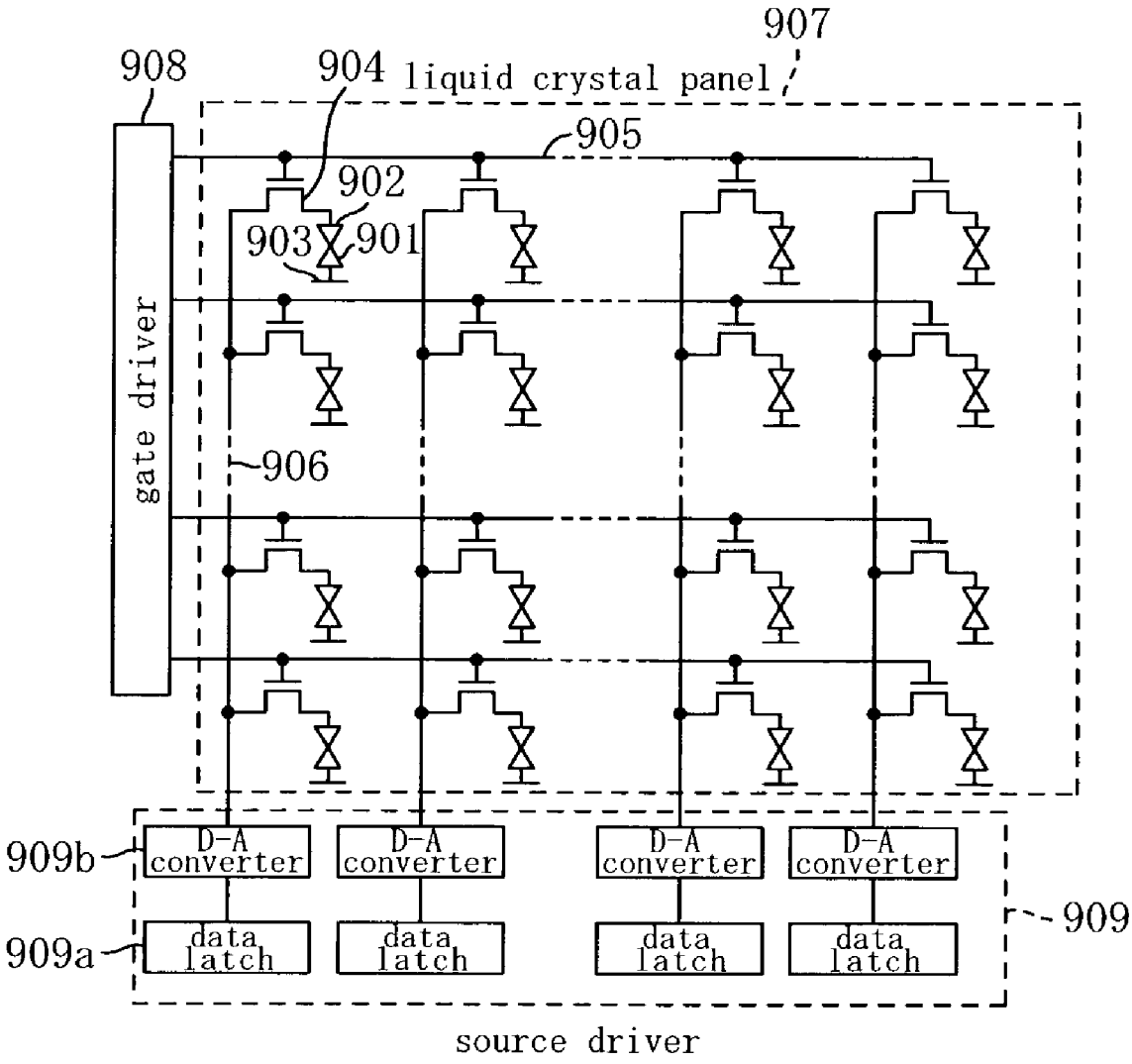
FIG. 21 is a circuit diagram showing the configuration of a conventional liquid crystal display device.

As described above, when all those source lines S1–Sn in which the applied voltages change are connected to each other, the potentials of those source lines S1–Sn can be easily brought to averaged potentials, but this is not meant to limit the embodiment. For example, a source driver 800 as shown in FIG. 19 may be provided so that the source lines are connected to either one of the source line-connecting line 610 or 620 according to whether the applied voltages change to high voltages or to low voltages. In this source driver 800, the transfer gates 611–61*n* and 621–62*n* for connecting the source lines S1–Sn to the source line-connecting line 610 or 620, which are similar to the foregoing Embodiment 4 (shown in FIG. 14), are controlled by the switching-controlling sections 541–54*n*, which are similar to the foregoing Embodiment 3 (shown in FIG. 10). Also, the switching-controlling sections 54*n*-1, 54*n*, . . . and so forth that correspond to the second group of the source lines Sn-1, Sn, . . . and so forth are supplied with the inverted signals of the outputs from the data latches 45*n*-1, 55*n*-1, . . . and so forth that are inverted by the NOT circuits 63*n*-1, . . . and so forth. Thus, as seen from FIG. 20, those source lines S1, . . . and so forth of the first group in which the applied voltages change to high voltages are connected to those source lines Sn, . . . and so forth of the second group in which the applied voltages change to low voltages, and those source lines S2, . . . and so forth of the first group in which the applied voltages change to low voltages are connected to those source lines Sn-1, . . . and so forth of the second group in which the applied voltages change to high voltages. As a consequence, voltages are averaged between the connected source lines, and the current flowing through those source lines to which high voltages are applied next can be reduced.

As has been described thus far, in one embodiment of the present invention, the source lines are connected to a capacitor element and thereafter to an opposing electrode. In another embodiment, capacitor elements connected to the source lines are switched according to image data signals, and/or according to change between a previous image data signal and a subsequent image data signal. In further another embodiment, the source lines are selectively connected to each other according to image data signals or according to change between a previous image data signal and a subsequent image data signal. Thus, power consumption can be significantly reduced easily. Moreover, the time required for storing and supplying an electric charge can be shortened, and further, the circuit scale can be reduced.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A liquid crystal panel driving device for a liquid crystal display device comprising source lines, pixel switches, pixel electrodes connected to the source lines through the pixel switches, and an opposing electrode opposed to the pixel electrodes, the liquid crystal panel driving device alternately applying to the pixel electrodes through the source lines high voltages and low voltages that are respectively higher and lower than a predetermined voltage, both of the voltages corresponding to image data for pixels, the liquid crystal panel driving device comprising:

a charge-storing means for storing an electric charge;

a charge-storing means-connecting means for connecting and disconnecting the source lines and the storing means;

an opposing electrode-connecting means for connecting and disconnecting the source lines and the opposing electrode; and a controlling means for controlling the charge-storing means-connecting means and the opposing electrode-connecting means such that, after applying one of the high voltage and the low voltage to a set of the pixel electrodes but before applying the other one of the voltages to a subsequent set of the pixel electrodes, the source lines are connected to the electric charge-storing means and subsequently the source lines are connected to the opposing electrode, wherein the charge-storing means comprises a first charge-storing means and a second charge-storing means;

the charge-storing means-connecting means comprises a first charge-storing means connecting-means for connecting and disconnecting the first charge-storing means, and a second charge-storing means-connecting means for connecting and disconnecting the second electric charge-storing means; and the charge-storing means-connecting means further comprises a mutually-connecting means for mutually connecting and disconnecting the first charge-storing means and the second charge-storing means; and the controlling means controls the first charge-storing means-connecting means, the second charge-storing means-connecting means, and the mutually-connecting means such that, after applying the high voltages to a previous set of the pixel electrodes but before applying the low voltages to a subsequent set of the pixel electrodes, the source lines are connected to the first electric charge-storing means at first timing and thereafter the source lines are connected to the opposing electrode at second timing, and after applying the low voltages to the subsequent set of the pixel electrodes but before applying the high voltages to a further subsequent set of the pixel electrodes, the source lines are connected to the second electric charge-storing means at third timing and thereafter the source lines are connected to the opposing electrode at fourth timing, and the first electric charge-storing means and the second electric charge-storing means are mutually connected at fifth timing that is later than the first timing or the third timing.

2. A liquid crystal panel driving device for a liciuid crystal display device comprising source lines, pixel switches, pixel electrodes connected to the source lines through the pixel switches, and an opposing electrode opposed to the pixel electrodes, the liqiuid crystal panel driving device alternately applying to the pixel electrodes through the source lines high voltages and low voltages that are respectively higher and lower than a predetermined voltage, both of the voltages corresponding to image data for pixels, the liquid crystal panel driving device comprising:

a charge-storing means for storing an electric charge;

a charge-storing means-connecting means for connecting and disconnecting the source lines and the storing means;

an opposing electrode-connecting means for connecting and disconnecting the source lines and the opposing electrode; and a controlling means for controlling the charge-storing means-connecting means and the opposing electrode-connecting means such that, after applying one of the high voltage and the low voltage to a set of the pixel electrodes but before applying the other one of the voltages to a subseciuent set of the pixel electrodes, the source lines are connected to the electric charge-storing means and subsequently the source lines are connected to the opposing electrode, wherein the charge-storing means comprises a first charge-storing means and a second charge-storing means;

the charge-storing means-connecting means comprises a first charge-storing means-connecting means for connecting and disconnecting the first charge-storing means and a second charge-storing means-connecting means for connecting and disconnecting the second charge-storing means; and the controlling means controls the first charge-storing means-connecting means and the second charge-storing means-connecting means such that, after applying one of the high voltages and the low voltages to a previous set of the pixel electrodes but before applying the other one of the voltages to a next set of the pixel electrodes, the source lines are connected at first timing to one of the first charge-storing means and the second charge-storing means corresponding to the applied voltages, thereafter the source lines are connected to the opposing electrode at second timing, and the source lines are connected to the other one of the first charge-storing means and the second charge-storing means at third timing that is later than the second timing.

3. A liquid crystal panel driving device for a liquid crystal display device comprising source lines, pixel switches, pixel electrodes connected to the source lines through the pixel switches, and an opposing electrode opposed to the pixel electrodes, the liqiuid crystal panel driving device alternately applying to the pixel electrodes through the source lines high voltages and low voltages that are respectively higher and lower than a predetermined voltage, both of the voltages corresponding to image data for pixels, the liquid crystal panel driving device comprising:

a charge-storing means for storing an electric charge;

a charge-storing means-connecting means for selectively connecting and disconnecting the source lines to one of terminals of the charge-storing means or the other one of the terminals thereof;

a controlling means for controlling the charge-storing means-connecting means such that, after applying one of the high voltages and the low voltages to the pixel electrodes but before applying the other one of the voltages to the pixel electrodes, the source lines are connected to one of the terminals of the charge-storing means at first timing, and thereafter, the source lines are connected to the other one of the terminals of the charge-storing means at second timing;

an opposing electrode-connecting means for connecting and disconnecting the source lines and the opposing electrode; and wherein the controlling means controlling the opposing electrode-connecting means such that the source lines are connected to the opposing electrode at third timing that is between the first timing and the second timing.

* * * * *

UNITED STATES PATENT AND TRADEMARK OFFICE

CERTIFICATE OF CORRECTION

PATENT NO. : 7,084,852 B2
APPLICATION NO. : 10/385433
DATED : August 1, 2006
INVENTOR(S) : Kazuyoshi Nishi et al.

It is certified that error appears in the above-identified patent and that said Letters Patent is hereby corrected as shown below:

On the title page, Item (56)

Reference Cited, FOREIGN PATENT DOCUMENTS, change "EP 10-282524 10/1998 " to -- JP 10-282524 10/1998 --

Signed and Sealed this

Ninth Day of January, 2007

JON W. DUDAS
*Director of the United States Patent and Trademark Office*